United States Patent [19]

Tachibana et al.

[11] Patent Number: 4,956,270

[45] Date of Patent: Sep. 11, 1990

[54] SILVER HALIDE PHOTOGRAPHIC MATERIAL HAVING IMPROVED ANTISTATIC AND ANTIBLOCKING PROPERTIES

[75] Inventors: Noriki Tachibana; Eiichi Ueda; Nobuaki Kagawa; Hideo Ota, all of Tokyo, Japan

[73] Assignee: Konishiroku Photo Industry Co., Ltd., Tokyo, Japan

[21] Appl. No.: 318,417

[22] Filed: Feb. 28, 1989

Related U.S. Application Data

[63] Continuation of Ser. No. 46,163, May 5, 1987, abandoned.

[30] Foreign Application Priority Data

May 6, 1986 [JP] Japan ..... 61-103534
May 7, 1986 [JP] Japan ..... 61-104371

[51] Int. Cl.[5] ..... G03C 1/94

[52] U.S. Cl. ..... 430/527; 430/523; 430/539; 430/561

[58] Field of Search ..... 430/527, 539, 961, 523

[56] References Cited

U.S. PATENT DOCUMENTS

| | | | |
|---|---|---|---|
| 2,428,456 | 2/1969 | Grabhofer et al. . | |
| 2,882,157 | 4/1959 | Thompson et al. . | |
| 2,982,651 | 5/1961 | MacKey . | |
| 3,062,785 | 11/1962 | Laakso et al. . | |
| 3,454,625 | 7/1969 | Eiseman, Jr. et al. . | |
| 3,457,076 | 7/1969 | Yano et al. . | |
| 3,939,999 | 2/1976 | Yoneyama et al. . | |
| 4,013,696 | 3/1977 | Babbitt | 430/961 |
| 4,047,957 | 9/1977 | Dewinter et al. | 430/961 |
| 4,050,940 | 9/1977 | Habu et al. | 430/527 |
| 4,229,524 | 10/1980 | Yoneyama et al. | 430/527 |
| 4,267,265 | 5/1981 | Sugimoto et al. | 430/961 |
| 4,272,615 | 6/1981 | Yoneyama et al. | 430/527 |
| 4,304,852 | 12/1981 | Sugimoto et al. | 430/527 |
| 4,330,618 | 5/1982 | Minamizawa et al. | 430/527 |
| 4,347,308 | 8/1982 | Takeuchi et al. | 430/527 |
| 4,366,238 | 12/1982 | Yokoyama et al. | 430/527 |
| 4,495,275 | 1/1985 | Yokoyama et al. | 430/527 |
| 4,499,179 | 2/1985 | Ota et al. | 430/961 |
| 4,582,731 | 4/1986 | Chen et al. | 430/527 |
| 4,596,766 | 6/1986 | Nemori et al. | 430/527 |
| 4,622,288 | 11/1986 | Yokoyama et al. | 430/527 |
| 4,675,278 | 6/1987 | Sugimoto et al. | 430/961 |

*Primary Examiner*—Jack P. Brammer
*Attorney, Agent, or Firm*—Finnegan, Henderson, Farabow, Garrett, and Dunner

[57] ABSTRACT

A silver halide photographic material that has at least one hydrophilic colloidal layer on a support is disclosed, wherein said at least one hydrophilic colloidal layer contains an organic fluoro-compound and/or a nonionic surfactant having a polyoxuehylene unit and is hardened with a high-molecular weight hardening agent.

13 Claims, No Drawings

SILVER HALIDE PHOTOGRAPHIC MATERIAL HAVING IMPROVED ANTISTATIC AND ANTIBLOCKING PROPERTIES

This application is a continuation of application Ser. No. 046,163 filed May 5, 1987 now abandoned.

BACKGROUND OF THE INVENTION

1. Field of the Invention

The present invention relates to a silver halide photographic material, in particular to one which has improved antistatic and antiblocking properties and which is free from the problem of unevenness in image density due to the fouling of transport rollers.

2. Description of the Prior Art

The outermost layer of silver halide photographic materials generally uses hydrophilic colloids (typically gelatin) as binders. Because of the use of such binders, the surface of silver halide photographic materials, when placed in a hot and humid atmosphere, will have increased adhesiveness or stickiness and will readily stick to other objects with which they come in contact.

This phenomenon commonly referred to as "blocking" in the art will take place between two adjacent silver halide photographic materials or between a silver halide photographic material and another object with which it comes in contact during manufacture or storage of the silver halide photographic materials or during imaging (i.e., when pictures are taken on such photographic materials). The blocking phenomenon has been a great concern in the art, particularly in silver halide color photographic materials which incorporate color couplers and many other additives in photographic layers.

In order to solve this problem, it has been proposed that the blocking nature of silver halide photographic materials be decreased by incorporating the fine particles of inorganic substances (e.g., silicon dioxide, magnesium oxide, titanium dioxide and calcium carbonate) or organic substances (e.g., polymethyl methacrylate, cellulose acetate propionate and fluoropolymers) so that the photographic materials will have a roughened (i.e., matted) surface. For the reason already mentioned, such matting agents have to be incorporated in large quantities in silver halide color photographic materials. However, if matting agents are used in excessive amounts, image quality, in particular, sharpness of image is adversely affected. Therefore, there is a certain limit on the amount of matting agents that can be employed.

Besides the blocking phenomenon, buildup of static charges is another great concern in silver halide photographic materials which usually employ electrically insulating supports. While static buildup can cause many troubles, the most serious one is that the static electricity that has built up before processing is discharged to allow the lightsensitive emulsion layer to become exposed so that unevenness in image density either in the form of circular spots or tree-like or feather-like marks will occur in the processed films. These spots or marks are generally referred to as "static marks" in the art and greatly impair the commercial value of photographic films. For instance, static marks on the surface of a developed medical or industrial X-ray film can mislead the doctor to a wrong and, hence, very dangerous diagnosis. One of the problems associated with static marks is that they become evident only after development has been undertaken. Static buildup can induce secondary troubles such as attraction of dust particles to the film surface and failure to form a uniform coating layer.

As already mentioned, buildup of static charges often occurs during manufacture and use of photographic materials. In the manufacturing process, the frictional contact between a photographic film and rollers, or the separation between the surfaces of the support and the emulsion layer that takes place during film winding or rewinding is the primary cause of static buildup. Static charges will also develop in a finished photographic film roll when the base surface of a layer separates from the emulsion surface of an adjacent layer as the film is wound up in a camera. In X-ray films, static buildup occurs as a result of contact with, and separation from, a fluorescent intensifying screen or the mechanical parts of the automatic film imaging apparatus. Static buildup also occurs in finished photographic films when they come in contact with packaging materials. The severity of static marks that are induced in photographic materials as a result of static buildup increases as the sensitivity of the photographic materials or the rate of development and subsequent steps of photographic processing increases. Modern photographic materials are designed to have higher sensitivities and the chance of their being subjected to handling under hostile conditions is increasing because of the requirement for employing higher speeds on such occasions as application of coating layers, imaging, and automatic processing. These factors all lead to an even greater chance of the occurrence of static marks.

In order to avoid the occurrence of troubles due to 15 static electricity, it is preferable to incorporate antistatic agents in photographic materials. However, not all of the antistats that are in common use can be straight forwardly employed in photographic materials because the use and choice of suitable antistats is subject to various constraints that are peculiar to photographic materials. Antistatic agents that can be used in photographic materials must of course exhibit a good antistatic performance. In addition, they must satisfy various other requirements such as freedom from any adverse effects on the film quality and antiblocking properties of the photographic material in which they are incorporated, freedom from the chance of causing premature contamination of processing solutions, and freedom from unevenness in the density of image formed on the film that may occur after processing as a result of the fouling of transport rollers. In this way, the application of antistats to photographic materials is limited by a large number of factors.

With a view to providing enhanced electrical conductivity for the support and coated surface layers of silver halide photographic materials, the use of various kinds of hydroscopic substances, water-soluble inorganic salts, surfactants and polymers has been attempted. For example, the use of surfactants is described in U.S. Pat. Nos. 2,982,651, 3,428,456, 3,457,076, 3,454,625, and Japanese Patent Application (OPI) Nos. 7762/1980, 3636/1981 and 114944/1981 (the term "OPI" as used hereinafter means an unexamined published Japanese patent application), and the incorporation of polymers is shown in U.S. Pat. Nos. 2,882,157, 3,062,785, 3,938,999, and Japanese Patent Application (OPI) Nos. 78834/1981, 204540/1982, 179837/1982 and 2242/1983.

However, it is very difficult to accomplish complete prevention of static buildup on hydrophilic colloidal layers and known antistatic methods either fail to cause a satisfactory drop in surface resistivity at low humidities or sometimes induce "blocking" problems in a hot and humid atmosphere. In addition, if an antistat (e.g., a fluorine-containing surfactant of the type described in Japanese Patent Publication No. 44411/1981) is incorporated in a hydrophilic colloidal layer in the necessary amount to attain the intended antistatic effect, the quality of that layer may be adversely affected or the antistat will be transferred into processing solutions so as to cause unwanted phenomena such as sludge formation.

The use of an antistatic agent in the form of a nonionic surfactant containing a polyoxyethylene unit is disclosed in such prior patents as Japanese Patent Application (OPI) No. 80023/1977, West German Patent Nos. 1,422,809 and 1,422,818, and Australian Patent No. 54,441/1959. The nonionic surfactants with a polyoxyethylene unit that are shown in these patents impart improved antistatic properties to the photographic materials in which they are incorporated but, on the other hand, they cause adverse effects on the photographic characteristics of the product such as the sensitivity, antifogging property, granularity and sharpness of photographic emulsions; in addition, such nonionic surfactants will contaminate processing solutions or product unwanted deposit formation on rollers.

According to Japanese Patent Publication No. 9610/1986, the antistatic performance of an ethylene oxide addition polymer of the condensation product of phenol and formaldehyde can be improved by combining it with a variety of coating aids. However, this method is incapable of preventing the occurrence of troubles due to the fouling of transport rollers or contamination introduced in the stage of photographic processing.

Japanese Patent Application (OPI) Nos. 29715/1978 and 76741/1985 disclose photographic materials containing a specified anionic surfactant and a nonionic surfactant having a polyoxyethylene unit. These methods, however, are still ineffective for the purpose of preventing the occurrence of film troubles due to the contamination of processing solutions or the fouling of transport rollers.

Japanese Patent Application (OPI) Nos. 76742/1985 and 80849/1985 disclose techniques that rely on the combined use of a fluorine-containing compound with a nonionic surfactant having a polyoxyethylene unit. These methods provide an improved antistatic performance but they still are incapable of solving the aforementioned problems occurring in the processing stage, namely, the contamination of processing solutions and the fouling of transport rollers, both of which will lead to the unevenness of image density attainable by photographic processing.

SUMMARY OF THE INVENTION

A first object, therefore, of the present invention is to provide a silver halide photographic material having improved antistatic and antiblocking properties.

A second object of the present invention is to provide a silver halide photographic material that will neither contaminate processing solutions nor foul transport rollers and which will not be adversely affected in terms of its photographic characteristics such as fogging, graininess, sharpness and sensitivity.

These objects of the present invention can be attained by a silver halide photographic material that has at least one hydrophilic colloidal layer on a support, wherein said at least one hydrophilic colloidal layer contains an organic fluoro-compound and/or a nonionic surfactant having a polyoxyethylene unit and is hardened with a high-molecular weight hardening agent.

DETAILED DESCRIPTION OF THE INVENTION

Examples of the organic fluoro-compound that may be incorporated in the silver halide photographic material of the present invention include fluorine-containing surfactants and fluorine-containing polymers: the first class of compounds are described in such patents as British patent Nos. 1,293,189, 1,259,398, U.S. Pat. Nos. 3,589,906, 3,666,478, 3,754,924, 3,775,236, 3,850,640, Japanese Patent Application (OPI) Nos. 48520/1979, 114944/1981, 161236/1975, 151127/1976, 59025/1975, 113221/1975, 999525/1975, Japanese Patent Publication Nos. 43130/1973, 6577/1982, Japanese Patent Application Nos. 83566/1982, 80773/1982, Japanese Patent Application (OPI) Nos. 84712/1978, 64228/1982, and in general references such as I & EC Product Research and Development, 1 (3), September 1962, and Abura Kagaku (Oil Chemistry), 12 (12), p. 653; while compounds of the second class are described in such patents as Japanese Patent Application (OPI) Nos. 158222/1979, 129520/1977, 23828/1974, British Patent Nos. 1,352,975, 1,497,256, U.S. Patent Nos. 4,087,394, 4,016,125, 3,240,604, 3,679,411, 3,340,216, 3,632,534, Japanese Patent Application (OPI) Nos. 30940/1973, 129520/1977, and U.S. Patent 3,753,716.

Particularly preferable organic fluoro-compounds are the fluorine-containing surfactants of the following formula:

$$Rf-(A)m-X$$

where Rf is an alkyl group having at least 3 fluorine atoms (which may be substituted and is illustrated by dodecafluorohexyl or heptadecafluorooctyl), an alkenyl group having at least 3 fluorine atoms (which may be substituted and is illustrated by heptafluorobutylene or tetradecafluorooctyl), or an aryl group having at least 3 fluorine atoms (which may be substituted and is illustrated by trifluorophenyl or pentafluorophenyl); A is a divalent linking group; X is a hydrophilic group; and m is 0 or 1.

In the formula shown above, A is preferably an alkylene group (which may be substituted and is illustrated by ethylene or trimethylene), an arylene group (which may be substituted and is illustrated by phenylene), an alkylarylene group (which may be substituted and is illustrated by propylphenylene), an arylalkylene group (which may be substituted and is illustrated by phenylethylene), $$-SO_2-,\ -\overset{\overset{\displaystyle R}{|}}{N}-$$

(R is a hydrogen atom or an alkyl group)

$$-\overset{\overset{\displaystyle O}{\|}}{C}-O-,\ -O-\overset{\overset{\displaystyle O}{\|}}{C}-,\ -\overset{\overset{\displaystyle O}{\|}}{C}-,\ \text{or}\ -O-.$$

These groups may be combined in any suitable way to form a divalent linking group.

In the formula shown above, X is a hydrophilic group and examples thereof include a nonionic group of the formula $$(B-O)_nR_1$$

(where B is an optionally substituted alkylene group such as $-CH_2-CH_2-$, $-CH_2-CH_2-Ch_2$ $$-CH_2-CH_2-,\ -CH_2-CH_2-CH_2,\ -CH_2-\underset{\underset{OH}{|}}{CH}-CH_2 \text{ or } -\underset{\underset{CH_3}{|}}{CH}-CH_2-;$$

n signifies the average degree of polymerization of the polyoxyalkylene group and is an integer of 1–50; $R_1$ is a hydrogen atom, an optionally substituted alkyl group, or an optionally substituted aryl group), a hydrophilic betaine group of the formula $$-\overset{\overset{R_2}{|}}{\underset{\underset{R_3}{|}}{\oplus N}}-R_4-COO^{\ominus} \text{ or } -\overset{\overset{R_2}{|}}{\underset{\underset{R_3}{|}}{\oplus N}}-R_4-SO_3^{\ominus}$$

(where $R_4$ is an alkylene group having 1–5 carbon atoms, such as methylene, ethylene, propylene or butylene; $R_2$ and $R_3$ are each an optionally substituted $C_{1-8}$ alkyl group such as methyl, ethyl or benzyl, or an optionally substituted aryl group such as phenyl or tolyl), a hydrophilic cationic group of the formula $$-\overset{\overset{R_2'}{|}}{\underset{\underset{R_3'}{|}}{\oplus N}}-R_5.Y^{\ominus}$$

(where $R_2'$ and $R_3'$ are $R_3'$ as defined for $R_2$and $R_3$, $R_5$ is the same as defined for $R_2$; $Y^{\theta}$ is an anion such as in the form of a hydroxyl group, a halide group, a sulfuric acid group, a carbonic acid group, a perchloric acid group, an organic carboxylic acid group, an organic sulfonic acid group, or an organic sulfuric acid group), and a hydrophilic anionic group of the formula $$-SO_3M-,\ -OSO_3M,\ -COOM,\ -O-\overset{\overset{O}{\|}}{P}(OM)_2 \text{ or } -O-\overset{\overset{O}{\|}}{\underset{\underset{O-A_1-Rf_1}{|}}{P}}-OM$$

(where M is an inorganic or organic cation which is preferably a hydrogen atom, an alkali metal, an alkaline earth metal, ammonium or an alkylamine having 1–3 carbon atoms; $A_1$ and $Rf_1$ are each the same as defined for A and Rf. Particularly preferable examples of the hydrophilic group that is represented by X hydrophilic betaine and hydrophilic anionic groups.

Typical examples of the organic fluoro-compound that may be used in the present invention are specifically shown below:

$C_7F_{15}COOH$ F-1

$H(CF_2)_8CH_2COCH_2NH_2$ F-2

$C_8F_{17}SO_3K$ F-3

$C_8F_{17}SO_2\overset{\overset{C_3H_7}{|}}{N}-CH_2COOK$ F-4

$H(CF_2)_6COOCH_2CH_2CH_2SO_3Na$ F-5

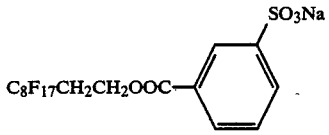

F-6

$C_7F_{15}CO\overset{\overset{CH_3}{|}}{N}-CH_2CH_2SO_3Na$ F-7

$H(CF_2)_6CH_2OOC-CH_2$
$H(CF_2)_6CH_2OOC-\underset{\underset{}{|}}{CH}-SO_3Na$ F-8

$C_8F_{17}SO_2\underset{\underset{C_2H_5}{|}}{N}CH_2COONa$ F-9

$H\text{-}(CF_2)_8CH_2O\text{-}(CH_2CH_2O)_p OC-CH_2$
$H\text{-}(CF_2)_8CH_2O\text{-}(CH_2CH_2O)_p OC-\underset{\underset{}{|}}{CH}-CH_2SO_3K$ F-10 p: 3 on average

-continued

F-11

$$C_8F_{17}SO_2N(C_3H_7)(CH_2CH_2O)_p(CH_2)_4SO_3Na$$

p: 4 on average

F-12

$$C_8F_{17}SO_2N(C_3H_7)(CH_2CH_2O)_p(CH_2)_3SO_3Na$$

p: 7 on average

F-13

$$C_{10}F_{21}CH_2CH_2O(CH_2CH_2O)_p(CH_2)_4SO_3Na$$

p: 6 on average

F-14

$$C_8F_{17}SO_2N(C_3H_7)-CH_2CH_2O-P(=O)(ONa)-ONa$$

F-15

$$[C_8F_{17}SO_2N(C_3H_7)(CH_2CH_2O)_p]_2P(=O)-ONa$$

p: 5 on average

F-16

$$C_8F_{17}SO_2N(C_3H_7)-CH_2CH_2OSO_3Na$$

F-17

$$H(CF_2)_8CH_2O(CH_2CH_2O)_{n^5}H$$

$n^5$:10

F-18

$$C_8F_{17}CH_2CH_2O(CH_2CH_2O)_{n^5}H$$

$n^5$:12

F-19

$$C_8F_{17}SO_2N(C_3H_7)(CH_2CH_2O)_{n^5}H$$

$n^5$:11

F-20

$$C_8F_{17}SO_2NHCH_2CH_2-\oplus N(CH_3)_2-CH_2COO^{\ominus}$$

F-21

$$C_8F_{17}SO_2N(CH_3)(CH_2CH_2O)_8SO_3Na$$

F-22

$$C_4F_9(CH_2CH_2O)_3SO_3Na$$

F-23

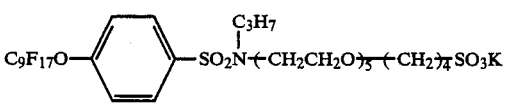

F-24

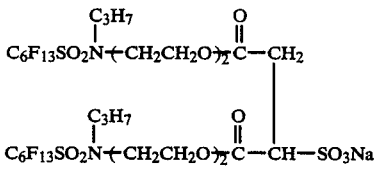

F-25

$$H(CF_2)_8CH_2O(CH_2CH_2)_4(CH_2)_3SO_3H$$

F-26

$$C_7F_{15}COO(CH_2CH_2O)_4(CH_2)_4SO_3K$$

F-27

$$C_8F_{17}SO_2N(C_3H_7)(CH_2CH_2O)_6CH_2COONa$$

-continued

F-28

$$H(CF_2)_8CH_2O(CH_2CH_2O)_3\overset{\overset{O}{\|}}{\underset{\underset{ONH_4}{|}}{P}}(ONH_4)$$

F-29

$$C_8F_{17}SO_2\overset{\overset{C_3H_7}{|}}{N}(CH_2CH_2O)_4\overset{\overset{O}{\|}}{\underset{\underset{ONa}{|}}{P}}(ONa)$$

F-30

$$C_8F_{17}SO_2\overset{\overset{C_3H_7}{|}}{N}(CH_2CH_2O)_4CH_2CH_2\overset{\oplus}{N}(CH_3)_3.CH_3-C_6H_4-SO_3^{\ominus}$$

F-31

$$C_8F_{17}SO_2NHCH_2CH_2OCH_2CH_2CH_2-\overset{\overset{CH_3}{|}}{\underset{\underset{CH_3}{|}}{\overset{\oplus}{N}}}-CH_2COO^{\ominus}$$

F-32

$$C_7F_{15}CONH-CH_2CH_2CH_2\overset{\overset{CH_3}{|}}{\underset{\underset{CH_3}{|}}{\overset{\oplus}{N}}}(CH_2)_4SO_3^{\ominus}$$

F-33

$$C_8F_{17}SO_2NHCH_2CH_2OCH_2CH_2CH_2-\overset{\overset{CH_3}{|}}{\underset{\underset{CH_3}{|}}{\overset{\oplus}{N}}}(CH_2)_4SO_3^{\ominus}$$

F-34

$$C_8F_{17}SO_2\overset{\overset{C_3H_7}{|}}{N}-CH_2CH_2\overset{\oplus}{N}(CH_3)_3.Cl^{\ominus}$$

F-35

$$C_8F_{17}SO_2NH(CH_2)_3\overset{\oplus}{N}(CH_3)_3.I^{\ominus}$$

F-36

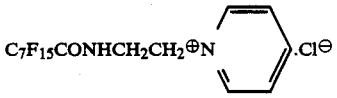

F-37

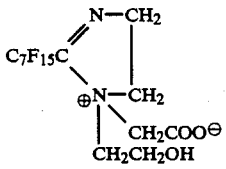

F-38

$$C_8F_{17}SO_2NHCH_2CH_2OCH_2CH_2-\overset{\overset{CH_3}{|}}{\underset{\underset{CH_3}{|}}{\overset{\oplus}{N}}}-CH_2CH_2OH.Br^{\ominus}$$

F-39

$$C_8F_{17}SO_2NHCH_2CH_2OCH_2CH_2CH_2\overset{\oplus}{N}(CH_3)_3CH_3-C_6H_4-SO_3^{\ominus}$$

F-40

$$C_8F_{17}SO_2NH(CH_2CH_2O)_pCH_2CH_2-\overset{\overset{CH_3}{|}}{\underset{\underset{CH_3}{|}}{\overset{\oplus}{N}}}-CH_2CH_2OH.Br^{\ominus}$$

p: 4 on average

F-41

$$C_8F_{17}CH_2CH_2OOC-\underset{\underset{C_6H_{13}O-OC-CH_2}{|}}{CH}-SO_3Na$$

Fluorine-containing polymers are also preferable for use as the organic fluoro-compound to be incorporated in the photographic material of the present invention.

The monomer units having a fluorine atom from which the fluorine-containing polymers are formed are preferably those which are derived from F-containing vinyl monomers, as well as those prepared by allowing a fluorinated alcohol to react with polymerized maleic anhydride; such monomer units are represented by the following general formula (I), (II) or (III).

In addition to the monomer units containing a fluorine atom, monomer units that are derived from other monomers copolymerizable with those basic monomer units may be present in the fluorine-containing polymers to such an extent that the objects of the present invention will not be impaired. Formulas (I), (II) and (III) are noted below:

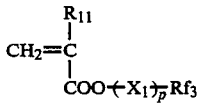

(I)

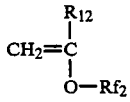

(II)

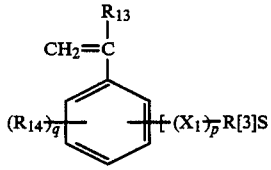

(III)

where $R_{11}$ and $R_{12}$ each signifies a hydrogen atom or a methyl group that may be substituted by a fluorine atom; $Rf_2$ is a straight-chained, branched or cyclic alkyl group that is substituted by a fluorine atom, said alkyl group preferably having 1–10 carbon atoms and optionally containing a nonfluorine substituent such as a hydroxyl group or a halogen atom (e.g., Cl or Br), provided that the carbon chain of the alkyl group represented by $Rf_2$ may be interrupted by a linking group such as oxo, thio or carbonyl; $R_{13}$ is a hydrogen atom, a chlorine atom or an alkyl group having 1–3 carbon atoms; $R_{14}$ is a univalent substituent and if q is 2 or greater, two or more $R_{14}$ may combine with each other to form a ring; $Rf_3$ is an alkyl, arylalkyl, aryl or alkylaryl group with 1–30 carbon atoms in which at least one hydrogen atom is replaced by a fluorine atom; $X_1$ is a divalent linking group the formula $$-(R_{15})_t L- \text{ or } -L-(R_{15})_t-$$

[where $R_{15}$ is a $C_{1-10}$ alkylene, arylene or aralkylene group; —L— is —O—, —S—, —NH—, —CO—, —OCO—, —CO—O—, —SCO—, —CONH—, —NH-CO—, $—SO_2—$, $—NR_{16}SO_2—$ (where $R_{16}$ is a hydrogen atom or an alkyl group having 1–4 carbon atoms), $—SO_2NH—$, —SO— or $—OPO_2—$; t is 0 or 1]; q is an integer of 0–4; p is an integer of 0–4; and s is an integer of 1–5.

Typical and specific examples of fluorine-containing vinyl monomers of formula (I), (II) or (III) that are preferably used in the present invention are given below under the headings of FM-1 to FM-41:

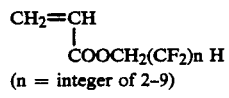

(n = integer of 2–9) FM-1

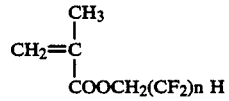

(n = integer of 2–9) FM-2

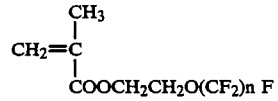

(n = integer of 2–8) FM-3

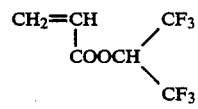

FM-4

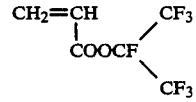

FM-5

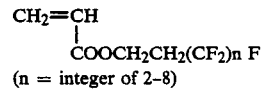

(n = integer of 2–8) FM-6

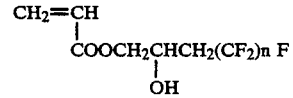

(n = integer of 2–8) FM-7

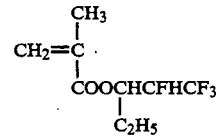

FM-8

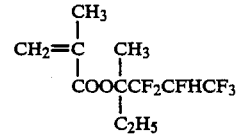

FM-9

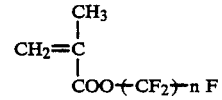

(n = integer of 2–8) FM-10

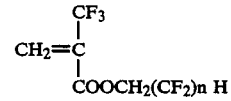

(n = integer of 2–9) FM-11

$CH_2{=}CH{-}O{-}CH_2{-}(CF_2)_n H$ FM-12

(n = integer of 2–8)

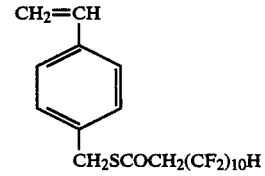

FM-13

-continued
FM-14
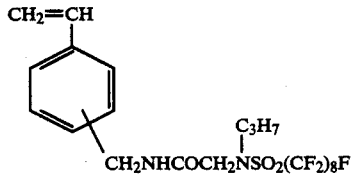
FM-15
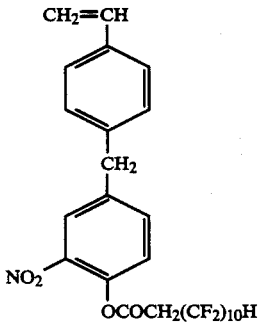
FM-16
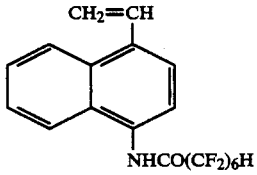
FM-17
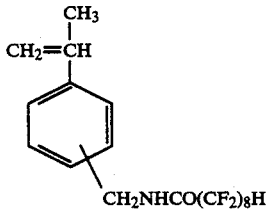
FM-18
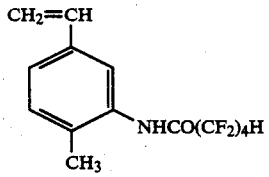
FM-19
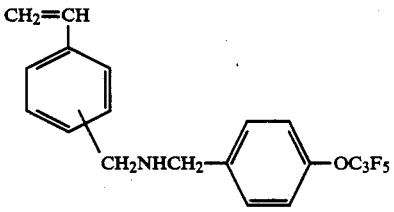
FM-20
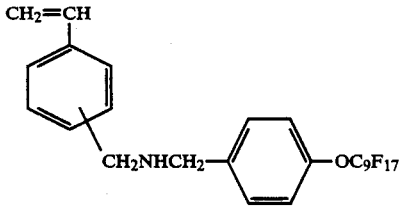
-continued
FM-21
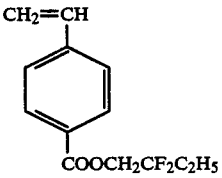
FM-22
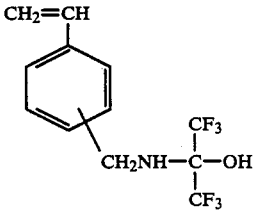
FM-23
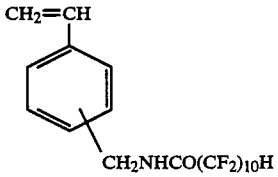
FM-24
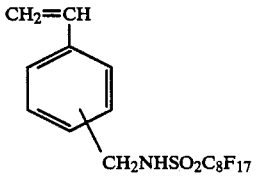
FM-25
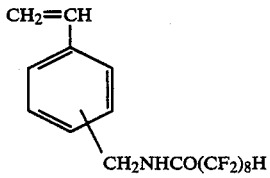
FM-26
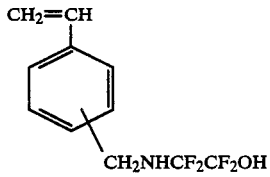
FM-27
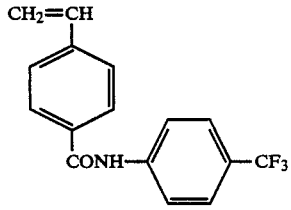
FM-28
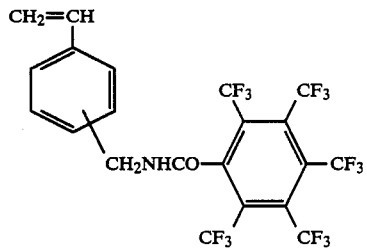

-continued

FM-29

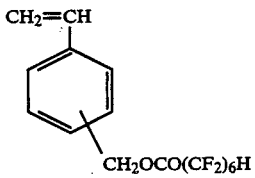

FM-30

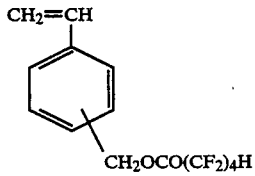

FM-31

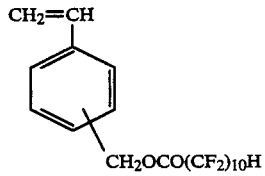

FM-32

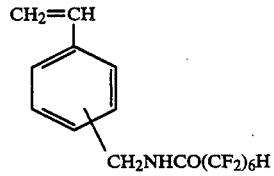

FM-33

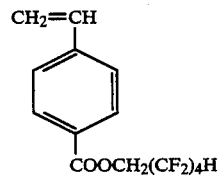

FM-34

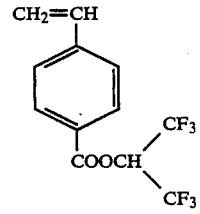

FM-35

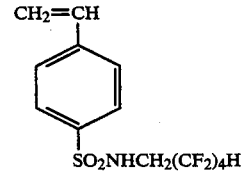

-continued

FM-36

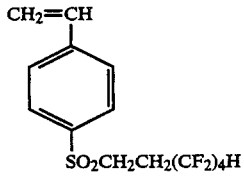

FM-37

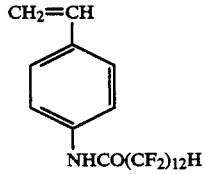

FM-38

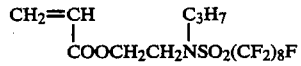

FM-39

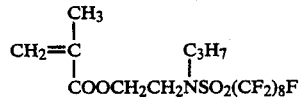

FM-40

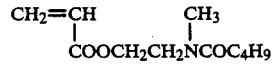

FM-41

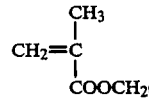

(n = integer of 2–9)

(The remaining space is left blank.)

Illustrative monomers that are copolymerizable with the fluorine-containing monomers include: acrylic acid esters such as butyl acrylate and cyclohexyl acrylate; methacrylic acid esters such as methyl methacrylate, ethyl methacrylate, cyclohexyl methacrylate and sulfopropyl methacrylate; vinyl esters such as vinyl acetate and vinyl propionate; vinyl ethers such as methyl vinyl ether and butyl vinyl ether; vinyl ketones such as methyl vinyl ketone and ethyl vinyl ketone; styrenes such as styrene, methylstyrene and chloromethylstyrene; as well as acrylonitrile, vinyl chloride, vinylidene chloride, butadiene and isoprene.

Specific examples of the fluorine-containing polymer are listed below but are by no means taken to limit the present invention.

F-42

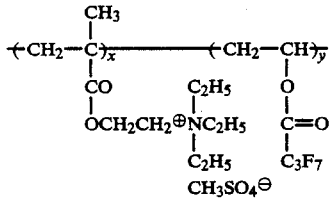

x:y = 80:20 (molar ratio as in the following cases)

-continued
F-43
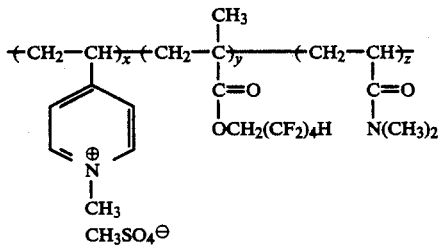
x:y:z = 70:20:10
F-44
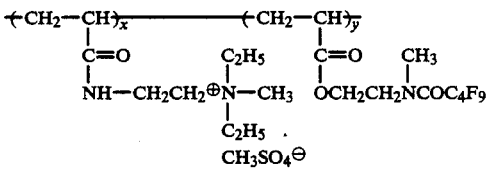
x:y = 65:35
F-45
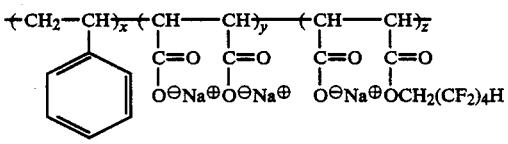
x:y:z = 50:20:30
F-46
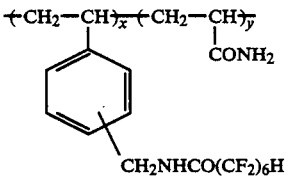
x:y = 21:97.9
F-47
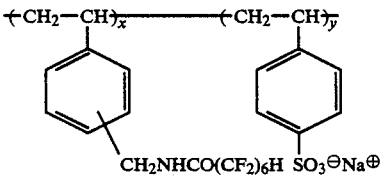
x:y = 35:65
F-48
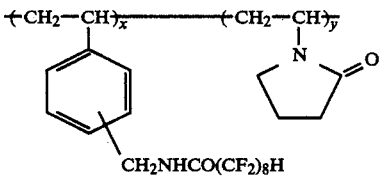
x:y = 3.7:96.3
F-49
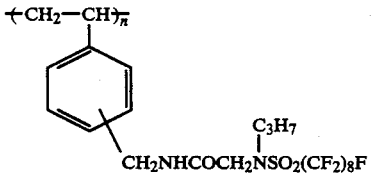
(water-dispersed latex)
F-50
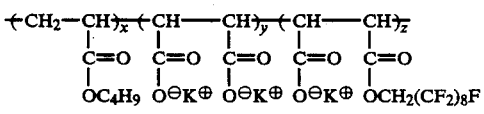
x:y:z = 50:20:30

-continued

F-51

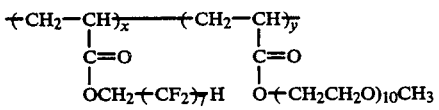

x:y = 40:60

F-52

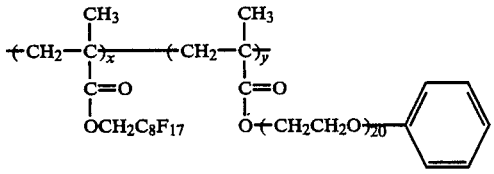

x:y = 70:30

F-53

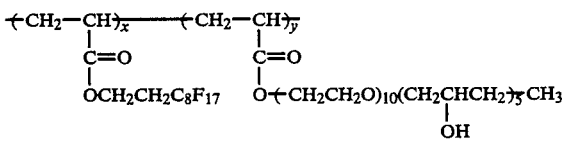

x:y = 50:50

F-54

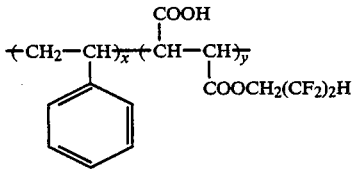

x:y = 50:50

F-55

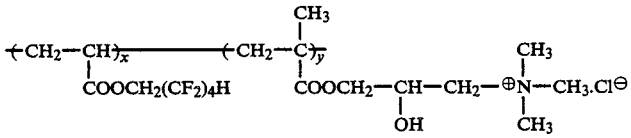

x:y = 50:50

(The remaining space is left blank.)

The nonionic surfactant having a polyoxyethylene unit that may be incorporated in a hydrophilic colloidal layer in the silver halide photographic material of the present invention together with, or in place of, the organic fluorocompound (this surfactant is hereinafter referred to simply as a nonionic surfactant) is described hereinafter.

A nonionic surfactant that is preferably used in the present invention may be selected from among the compounds of the following general formulas (N-I), (N-II) and (N-III):

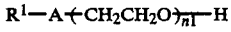

(N-I)

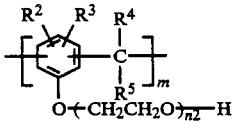

(N-II)

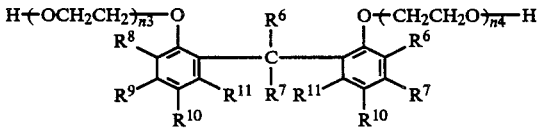

(N-III)

In formula (N-I), $R_1$ is a hydrogen atom or an alkyl, alkenyl or aryl group having 1–30 carbon atoms, preferably 4–24 carbon atoms, provided that these group may have a substituent; examples of the alkyl signified by $R_1$ include methyl, ethyl, octyl, dodecyl, tridecyl, hexadecyl and docosyl, with octyl, dodecyl, tridecyl and hexadecyl being preferable; illustrative substituents for the alkyl group signified by $R_1$ include a hydroxyl group, a halogen atom, an alkoxy group and an alkylthio group; the alkenyl group signified by $R_1$ are those having 1–30 carbon atoms, preferably 4–24 carbon atoms, specific examples being vinyl, allyl, isopropenyl, heptadecenyl and octadecenyl; examples of the aryl group signified by $R_1$ include phenyl and naphthyl; if these aryl groups have a substituent, it may be an alkyl group such as butyl, pentyl, octyl, nonyl, undecyl or pentadecyl; the aryl group may have 2 or more substituents, preferably 2 substituents which may be the same or different; if two substituents are present, they are preferably bonded to 1-position and 3- or 4-position in the case where the aryl group is phenyl, with bonding to 1- and 3-positions being more preferable; A is a divalent linking group such as

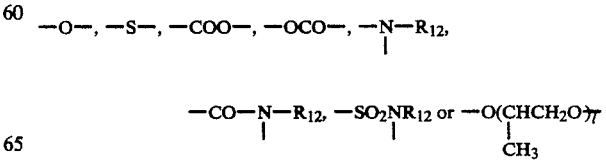

(where $R_{12}$ is a hydrogen atom or an optionally substituted alkyl group; l is a number of 1–20); $n_1$ signifies the average number of moles of ethylene oxide added and is within the range of 2–50, preferably 5–30, the range of 7–25 being particularly preferable.

In formula (N-II), $R_2$ and $R_3$ are each a hydrogen atom, an alkyl group, an alkoxy group or an acyl group; examples of the alkyl group signified by $R_2$ and $R_3$ include methyl, ethyl, octyl and nonyl, with octyl and nonyl being preferable; examples of the alkoxy group signified by $R_2$ and $R_3$ include methoxy, ethoxy and octoxy, with octoxy being preferable; examples of the acyl group signified by $R_2$ and $R_3$ include butyryl, isobutyryl and valeryl, with valeryl being preferable; $R_4$ and $R_5$ are each a hydrogen atom or an alkyl group such as methyl, ethyl or propyl, with methyl being preferable; m is an integer of 2–50, preferably 3–20; $n_2$ has the same meaning as $n_1$.

In formula (N-III), $R_6$ and $R_7$ each signifies a hydrogen atom, an alkyl group, an aryl group or a heterocyclic group; examples of the alkyl group signified by $R_6$ and $R_7$ include methyl, ethyl, propyl and butyl, with methyl and ethyl being preferable; examples of the aryl group signified by $R_6$ and $R_7$ include phenyl and naphthyl, with phenyl being preferable; examples of the heterocyclic group signified by $R_6$ and $R_7$ are furyl and thienyl, with furyl being preferable; $R_8$ and $R_{10}$ are each a halogen atom or an alkyl group; examples of the halogen atom signified by $R_8$ and $R_{10}$ are fluorine, chlorine and bromine atoms, with chlorine being preferable; examples of the alkyl group signified by $R_8$ and $R_{10}$ include methyl, ethyl, isopropyl, t-butyl, t-pentyl, t-hexyl, t-heptyl, t-octyl, nonyl, decyl, dodecyl and octadecyl, with methyl, ethyl, isopropyl, t-butyl, t-pentyl, t-hexyl, t-octyl and nonyl being preferable; $R_9$ is a hydrogen atom or an alkyl group such as methyl, ethyl or propyl, with hydrogen atom being preferable; $R_{11}$ is a hydrogen atom, an alkyl group or an alkoxy group, with hydrogen and alkoxy being preferable, the alkoxy being particularly preferable; examples of the alkyl group signified by $R_{11}$ include methyl, ethyl and propyl; examples of the alkoxy group signified by $R_{11}$ are methoxy, ethoxy and propoxy, with methoxy being preferable, $n_3$ and $n_4$ which may be the same or different have the same meaning as $n_1$, and preferably $n_3$ is the same as $n_4$.

The compounds of formulas (N-I), (N-II) and (N-III) may be found in U.S. Pat. Nos. 2,982,651, 3,428,456, 3,457,076, 3,454,625, 3,552,972, 3,655,387, Japanese Patent Publication No. 9610/1976, Japanese Patent Application (OPI) Nos. 29715/1978, 89626/1979, 203435/1983, 208743/1983, and "Shin-kaimenkasseizai (New Surfactants)", by H. Horiguchi, Sankyo Shuppan, 1975.

Specific examples of the nonionic surfactant that are preferably used in the present invention are given below:

$HO(CH_2CH_2O)_{12}H$ N-1

$HO(CH_2CH_2O)_{20}H$ N-2

$C_{17}H_{33}COO(CH_2CH_2O)_{15}H$ N-3

$C_8H_{17}O(CH_2CH_2O)_{7}H$ N-4

$C_{12}H_{25}O(CH_2CH_2O)_{10}H$ N-5

$C_{16}H_{33}O(CH_2CH_2O)_{12}H$ N-6

$C_{18}H_{35}O(CH_2CH_2O)_{16}H$ N-7

$C_{22}H_{45}O(CH_2CH_2O)_{25}H$ N-8

-continued

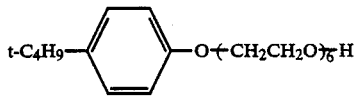

N-9

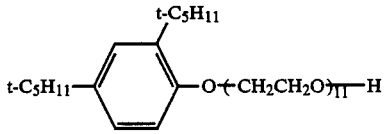

N-10

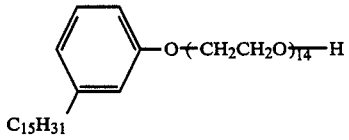

N-11

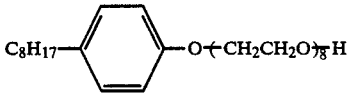

N-12

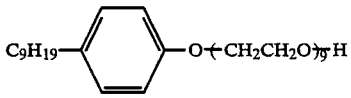

N-13

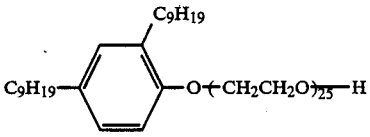

N-14

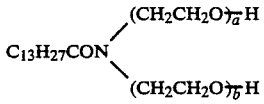

N-15 a + b = 15

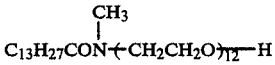

N-16

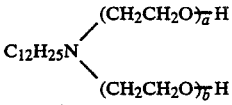

N-17 a + b = 20

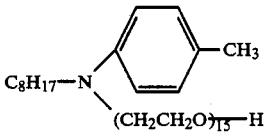

N-18

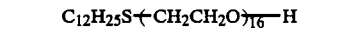

N-19

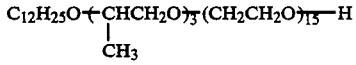

N-20

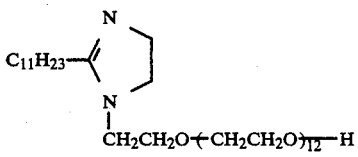

N-21

-continued
N-22
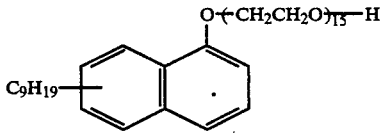
N-23
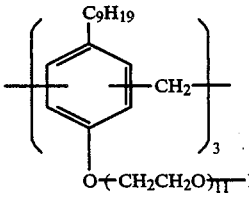
N-24
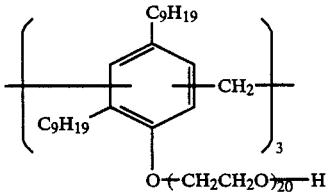
N-25
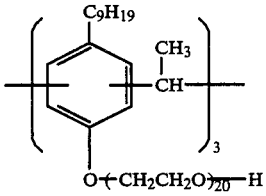
N-26
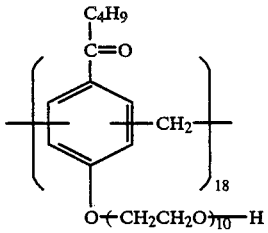
N-27
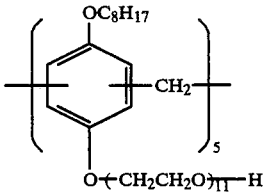
N-28
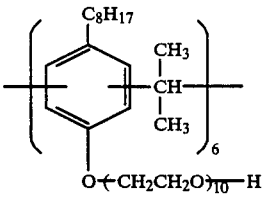
N-29
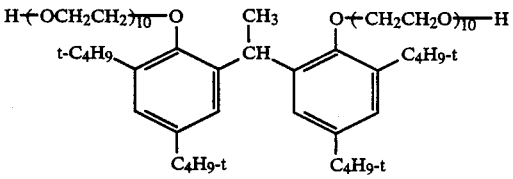
-continued
N-30
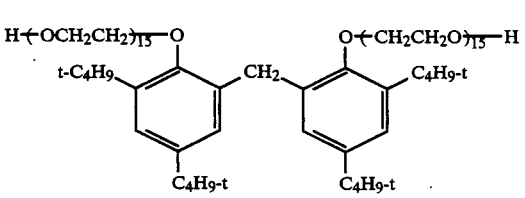
N-31
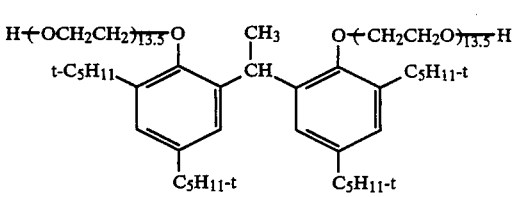
N-32
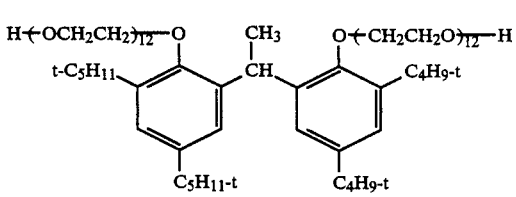
N-33
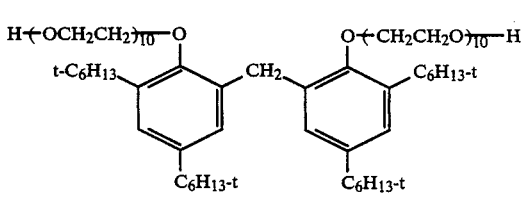
N-34
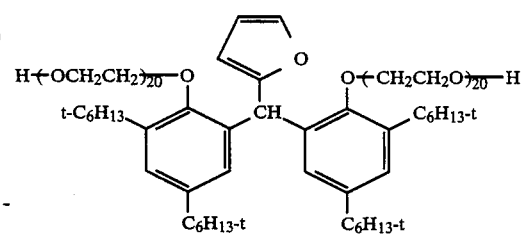
N-35
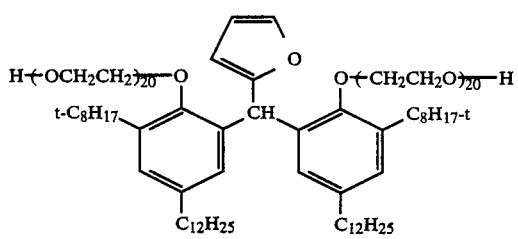
N-36
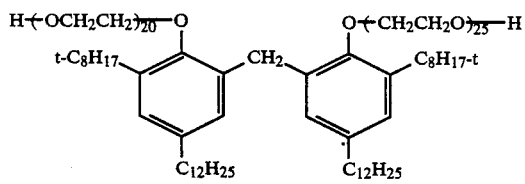

-continued

N-37

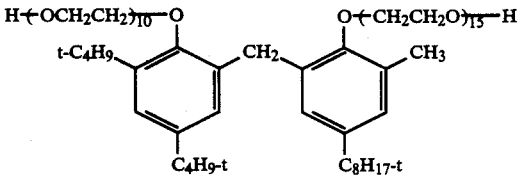

N-38

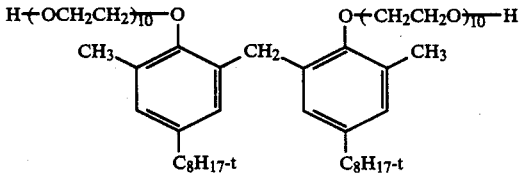

N-39

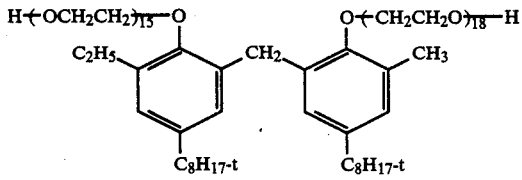

N-40

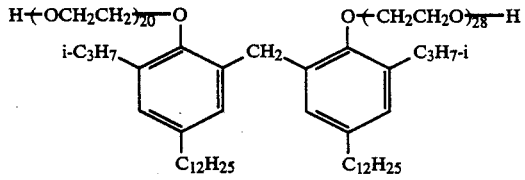

N-41

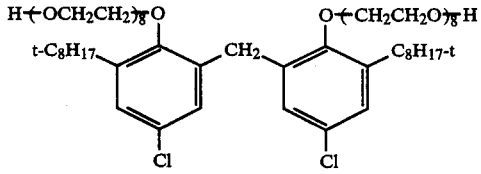

N-42

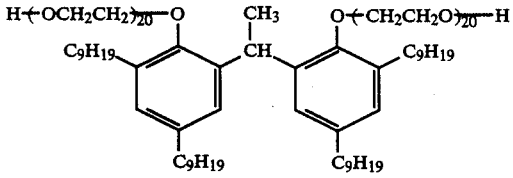

N-43

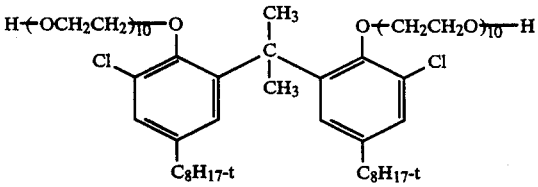

N-44

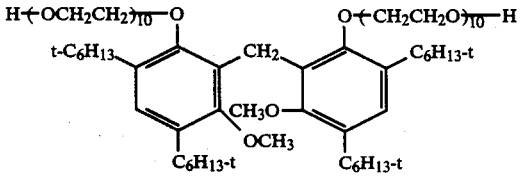

-continued

N-45

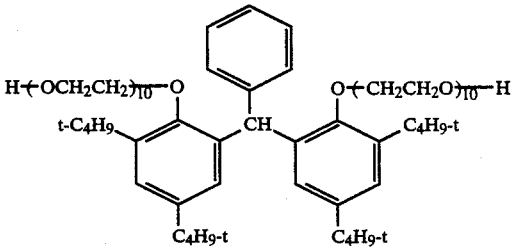

N-46

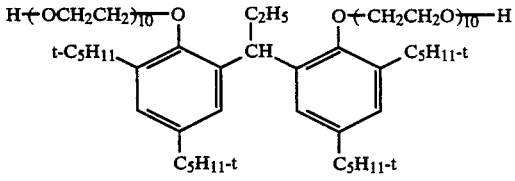

N-47

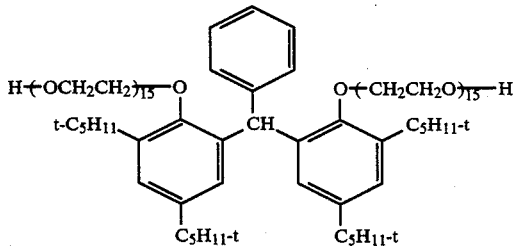

The organic fluoro-compound described hereinabove is preferably incorporated in a hydrophilic colloidal layer in an amount of 0.1 mg–2 g per square meter of the photographic material, with the range of 0.5 mg–800 mg being particularly preferable. The nonionic surfactant having a polyoxyethylene unit is preferably incorporated in a hydrophilic colloidal layer in an amount of 1.0–1,000 mg per square meter of the photographic material, with the range of 0.5–200 mg being particularly preferable.

If the nonionic surfactant and the organic fluoro-compound are used in combination, the latter is used at a ratio of 0.001–1, preferably at a ratio of 0.01–0.8, with respect to the former which is assumed to be one.

Each of the organic fluoro-compound and the nonionic surfactant is incorporated in a hydrophilic colloidal layer such as a silver halide emulsion layer, an intermediate layer, a surface protective layer, an overcoating layer or a back coating layer.

In a particularly preferred embodiment of the present invention, both the organic fluoro-compound and the nonionic surfactant are incorporated in the outermost layer of a silver halide photographic material of interest. Examples of the outermost layer are a surface protective layer and a back layer, and it is particularly preferable that both compounds are incorporated in a surface protective layer. If the back layer is a hydrophilic colloidal layer, the two compounds may also be incorporated in this back layer.

If the organic fluoro-compound is a fluorine-containing surfactant, it may be added as such into a hydrophilic colloidal solution; if a fluorine-containing polymer is used as the organic fluoro-compound, it is first dissolved in a suitable solvent before it is added to a hydrophilic colloidal solution.

The nonionic surfactant having a polyoxyethylene unit may be added as such into a hydrophilic colloidal solution.

In the present invention, an overcoat of the organic fluoro-compound may be formed on the surface protective layer by a suitable method such as the one described in Japanese Patent Publication No. 8456/1982. In this case, particularly good results are attained by a fluorine-containing surfactant which permeates into the surface protective layer in the drying step following the application of the overcoat.

In the silver halide photographic material of the present invention, at least one of the hydrophilic colloidal layers on a support contains the aforementioned organic fluoro-compound and/or nonionic surfactant having a polyoxyethylene unit and is hardened with a high-molecular weight hardening agent.

The term "high-molecular weight hardening agent" as used herein means a compound with a number average molecular weight of at least 3,000 that contains at least two hardening groups in the same molecule that are capable of reacting with a hydrophilic colloid such as gelatin.

Illustrative hardening groups that are capable of reacting with a hydrophilic colloid such as gelatin include aldehyde, epoxy, active halide (e.g., dichlorotriazine), active vinyl and active ester groups. At least two of these groups need to be present in the same molecule of a high-molecular weight hardening agent but preferably 10–5,000 of such groups are present. The high-molecular weight hardening agent should have a number average molecular weight of at least 3,000 and those which have molecular weights ranging from about $3\times10^3$ to about $5\times10^5$ are preferably used.

It is generally preferred that the high-molecular weight portion having hardening groups that are capable of reacting with a hydrophilic colloid such as gelatin is hydrophilic. Even a hardening agent whose high-molecular weight portion is not hydrophilic can be used after being emulsified/dispersed (with an organic solvent being optionally used as a dispersant) in a hydrophilic colloid (e.g., gelatin).

Examples of the high-molecular weight hardening agent that can be used in the present invention include: polymers having an aldehyde group such as dialdehyde starch, polyacrolein, and the acrolein copolymer described in U.S. Pat. No. 3,396,029; the polymer with an epoxy group that is described in U.S. Pat. No. 3,623,878; polymers with a dichlorotriazine group as described in U.S. Pat. No. 3,362,827 and Research Disclosure No. 17333 (1978); the polymer having an active ester group that is described in Japanese Patent Application (OPI) No. 66841/1981; and polymers having an active vinyl group or a precursor thereof as described in Japanese Patent Application (OPI) No. 142524/1981, U.S. Pat. No. 4,161,407, Japanese Patent Application (OPI) No. 65033/1979, and Research Disclosure No. 16725 (1978). Among these compounds, polymers having an active vinyl group or a precursor thereof are preferred. Particularly preferable polymers are of the type described in Japanese Patent Application (OPI) No. 142524/1981, in which an active vinyl group or a precursor thereof is bonded to the backbone chain of the polymer by a long spacer.

Specific examples of the high-molecular weight hardening agent that may be used in the present invention are listed below, in which the subscripts outside the brackets and under the line signify the molar ratios of structural units of individual compounds:

HP-1

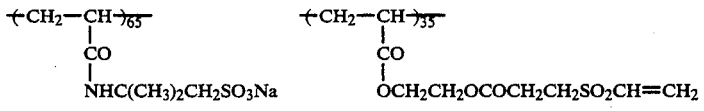

HP-2

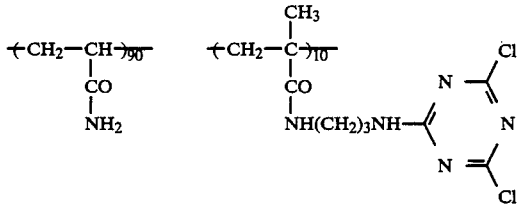

HP-3

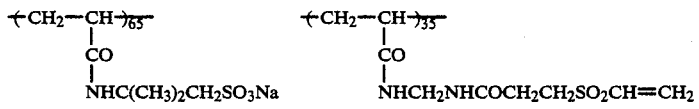

HP-4

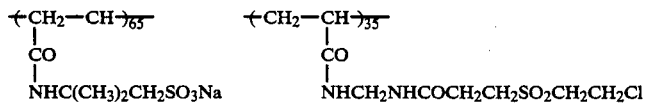

-continued
HP-5
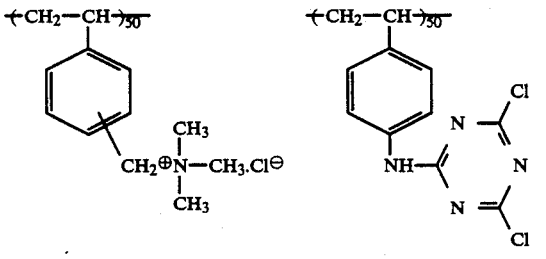
HP-6
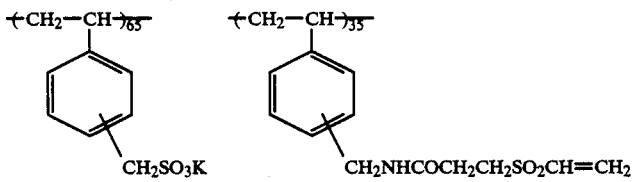
HP-7
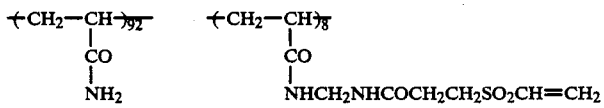
HP-8
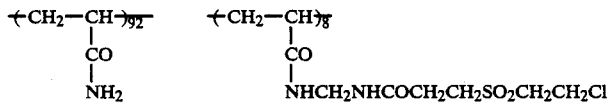
HP-9
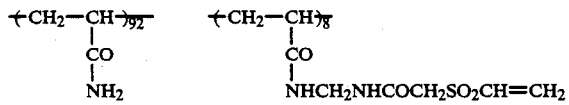
HP-10
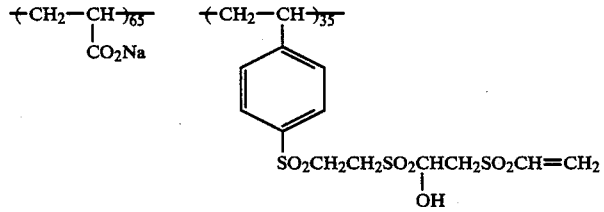
HP-11
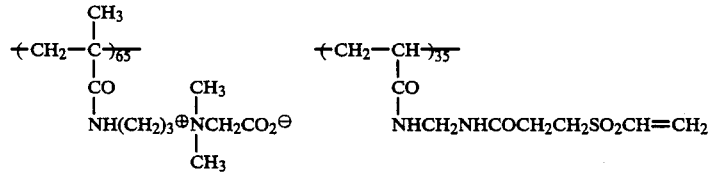
HP-12
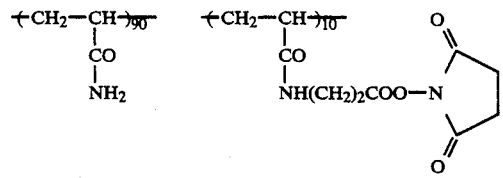
HP-13
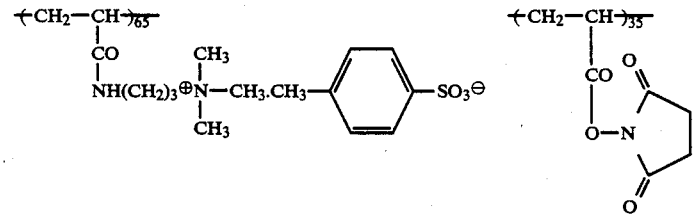

-continued
HP-14
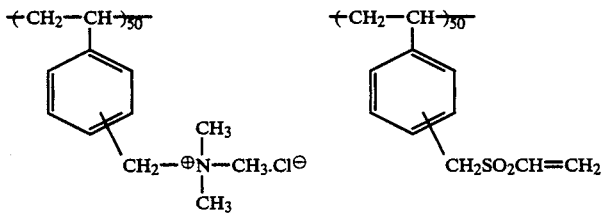
HP-15
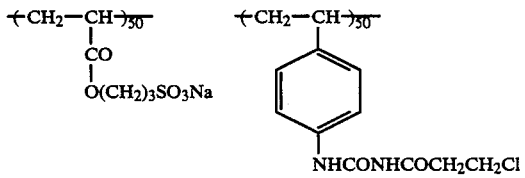
HP-16
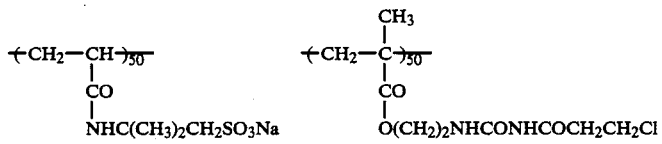
HP-17
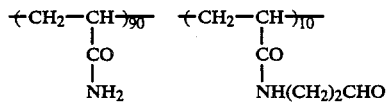
HP-18
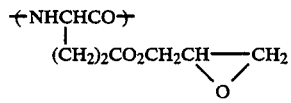
HP-19
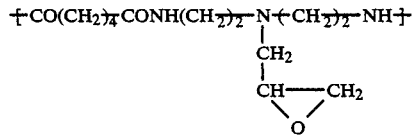
HP-20
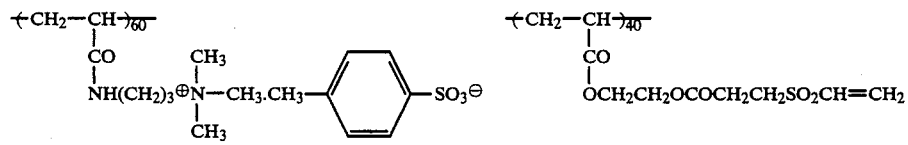
HP-21
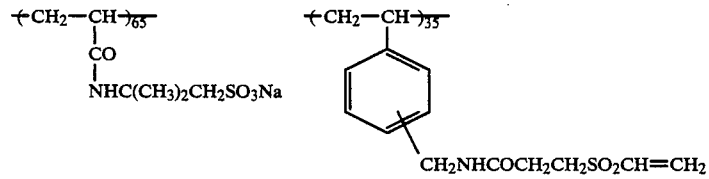
HP-22
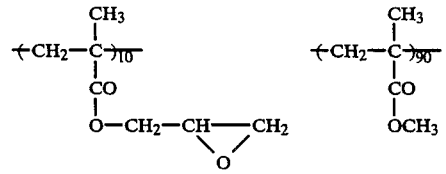
HP-23
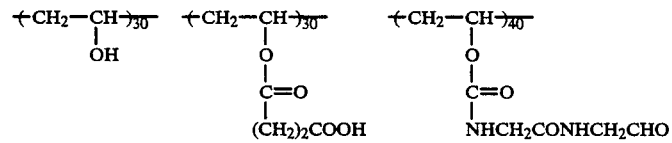

-continued

HP-24

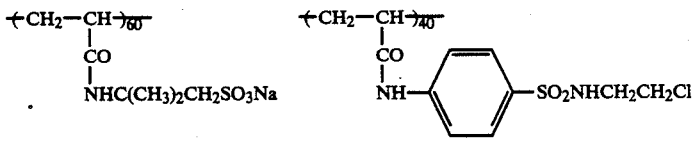

HP-25

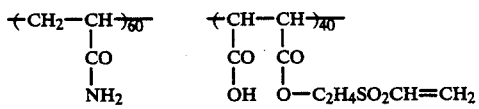

HP-26

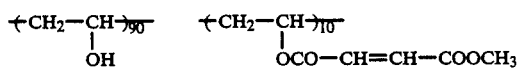

HP-27

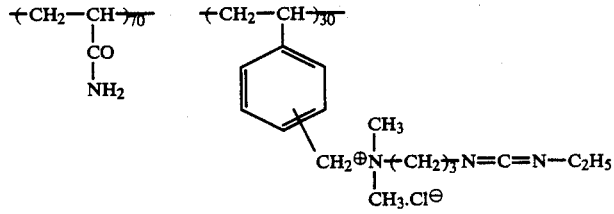

HP-28

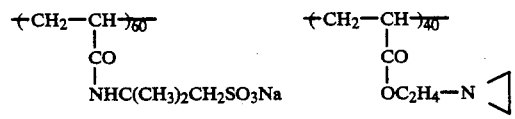

The above-listed polymers inherently contain at least two hardening groups in the same molecule that are capable of reacting with a hydrophilic colloid such as gelatin. Instead, the high-molecular weight hardening agent for use in the present invention may be synthesized in a coated hydrophilic colloidal layer from a hardener of a hydrophilic colloid such as gelatin and a polymer that reacts with said hardener to produce a polymer that contains at least two hardening groups within the same molecule. The objects of the present invention can also be attained by using such type of high-molecular weight hardening agent.

A gelatin hardener suitable for use in synthesizing a high-molecular weight hardening agent in a hydrophilic colloidal layer is a low-molecular weight hardening agent selected from among those described on pp. 77–84 of "The Theory of the Photographic Process", 4th ed. by T. H. James. Among the low-molecular weight hardening agents described in this book, those having a vinylsulfone group or a triazine ring are preferable, with the hardening agents disclosed in Japanese Patent Application (OPI) Nos. 41221/1978 and 225143/1985 being more preferable.

Specific examples of the gelatin hardener that provides the high-molecular weight hardening agent intended to be used in the present invention are listed below.

$(CH_2{=}CHSO_2CH_2CONHCH)_2{-}$ H-1

$(CH_2{=}CHSO_2CH_2CONHCH_2)_2CH_2$ H-2

$CH_2{=}CHSO_2CH_2CH(OH)CH_2SO_2CH{=}CH_2$ H-3

$CH_2{=}CH{-}SO_2{-}CH{=}CH_2$ H-4

$CH_2{=}CH{-}SO_2CH_2OCH_2{-}SO_2{-}CH{=}CH_2$ H-5

-continued $CH_2{=}CHSO_2CH_2CH_2CH_2SO_2CH{=}CH_2$ H-6

H-7

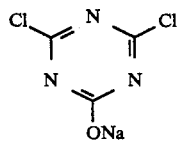

$OHC(CH_2)_3CHO$ H-8

Formaldehyde H-9

H-10

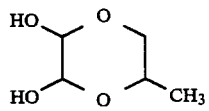

H-11

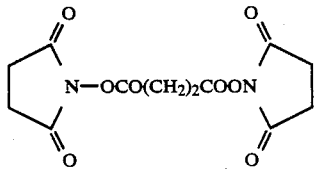

H-12

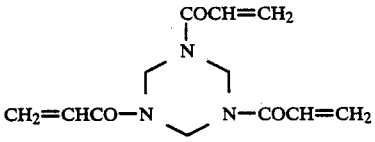

H-13

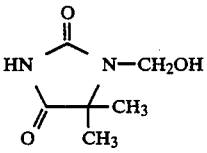

-continued $CH_2{=}CHSO_2CH_2CH_2SO_2CH{=}CH_2$ H-14

$(CH_2{=}CHSO_2CH_2)_4C$ H-15

$[(CH_2{=}CHSO_2CH_2)_4C].H_2NCH_2CH_2SO_3K$ Salt H-16

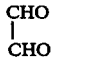
H-17

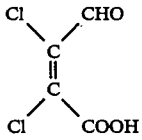
H-18

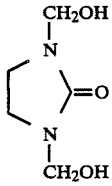
H-19

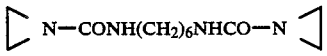
H-20

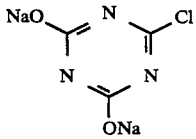
H-21

The polymer used for the purpose of making a high-molecular weight hardening agent within a hydrophilic colloidal layer is required to have at least two nucleophilic groups in the same molecule that react with the gelatin hardener; examples that meet this requirement are the polymer having a primary amino group that is described in British Patent No. 2,011,912, the polymer having a sulfinic acid group that is described in Japanese Patent Application (OPI) No. 4141/1981, the polymer having a phenolic hydroxyl group that is described in U.S. Pat. No. 4,207,109, and the polymer having an active methylene group that is described in U.S. Pat. No. 4,215,195.

Specific examples of the polymer that provides the high-molecular weight hardening agent intended to be used in the present invention are listed below.

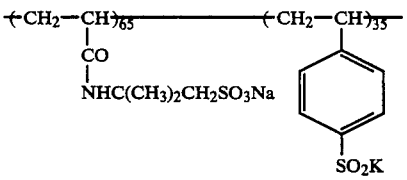
Q-1

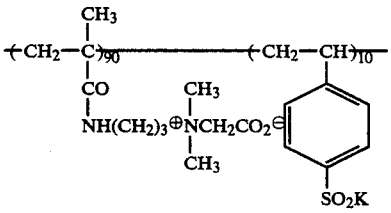
Q-2

-continued

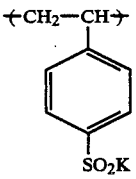
Q-3

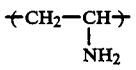
Q-4

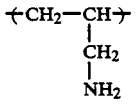
Q-5

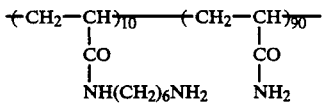
Q-6

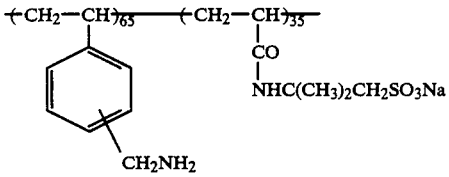
Q-7

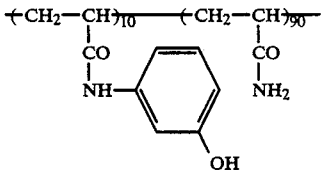
Q-8

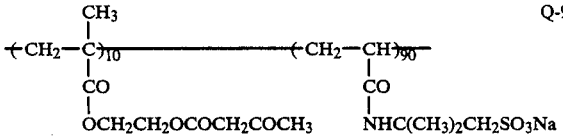
Q-9

Several examples of the synthesis of the high-molecular weight hardening agent suitable for use in the present invention are given below.

SYNTHESIS 1

Poly-N-[3-(vinylsulfonyl)propionyl]aminoacrylamide-co-sodium acrylamido-2-methylpropanesulfonate (HP-3)

(a) Synthesis of N-[3-(chloroethylsulfonyl)propionyl]aminomethyl acrylamide A reactor (capacity: 2,000 ml) is charged with 1,400 ml of distilled water, 224 g of sodium sulfite and 220 g of sodium hydrogen carbonate, and a solution is formed under stirring. After cooling to 5° C., 260 g of chloroethane sulfonyl chloride is added dropwise to the solution over a period of about 1.5 hours. Thereafter, 160 g of 49% sulfuric acid is added and the resulting crystal is recovered by filtration. The recovered crystal is washed with 400 ml of distilled water. The filtrate and the washings are charged into a 3-L reactor and 246 g of methylene bisacrylamide that is dissolved in 480 ml of distilled water and 1,480 ml of ethanol is added at 5° C. over a period of about 30 minutes. The resulting product is left to stand in a refrigerator for 5 days until the reaction is completed. The resulting crystal is recovered by filtration, washed with 800 ml of cooled distilled water, and recrystallized from 2,000 ml of 50% aqueous ethanol to obtain a white powder in an amount of 210 g (yield: 49%). This compound has a melting point of 192° C. or above (with decomposition).

(b) Synthesis of HP-3

A 200-ml reactor is charged with 5.65 g of the monomer prepared in (a), 9.16 g of sodium acrylamido-2-methylpropanesulfonate and 80 ml of 50% aqueous ethanol, and a solution is formed under stirring. With nitrogen bubbling, the solution is heated to 80° C. and 0.1 g of 2,2'-azobis(2,4-dimethylvaleronitrile) is added. Thirty minutes later, the same compound is added in the same amount and the solution is heated for an additional one hour under stirring. After cooling the solution to 10° C., a mixture of triethylamine (2.5 g) and ethanol (80 ml) is added, followed by continued stirring for one hour. The reaction product is added to 1,000 ml of acetone and the resulting precipitate is recovered by filtration and vacuum-dried to obtain a white polymer in an amount of 12.4 g (yield: 85%). This polymer has an intrinsic viscosity ($\eta$) of 0.227 and its vinyl sulfone content is $0.95\times10^{-3}$ equivalents per gram of the polymer.

SYNTHESIS 2

Poly-N-[2-(vinylsulfonyl)acetyl]aminomethylacrylamide-co-acrylamide (HP-7)

(a) Synthesis of N-[2-(chloroethylsulfonyl)acetyl]aminomethyl acrylamide

A 1-L reactor is charged with 720 ml of methanol and 80.8 g of N-methylolacrylamide. Under stirring, 40 ml of conc. HCl is added at room temperature and the mixture is stirred for an additional 16 hours. Thereafter, 0.4 g of hydroquinone monomethyl ether is added and methanol is distilled off with an evaporator. To the remaining oil (62.4 g), 100 g of chloroethane sulfonyl acetamide, 0.32 g of hydroquinone monomethyl ether and 0.22 g of p-toluenesulfonic acid are added and the mixture is heated at 150° C. so as to distill off the resulting $CH_3OH$. The reaction is completed in about 15 minutes and the residual crystal is subjected to recrystallization from 250 ml of 50% aqueous ethanol. A white powder is obtained in an amount of 61 g (yield: 42%).

(b) Synthesis of HP-7

A 3,000-ml reactor is charged with 53.7 g of the monomer prepared in (a), 163.3 g of acrylamide and 1,955 g of methanol, and a solution is formed under stirring With nitrogen bubbling, the solution is heated to 60° C. and 6.2 g of 2,2'-azobis(2,4-di-methylvaleronitrile) is added. After heating for 4 hours, the mixture is cooled to room temperature and 20.2 g of triethylamine is added, followed by stirring for an additional 2 hours. The resulting precipitate is recovered by filtration and vacuum-dried to obtain a white polymer in an amount of 194.3 g (yield: 92.7%). This polymer contains $0.50\times10^{-3}$ equivalents of vinyl sulfone per gram of the polymer.

An example of the method of synthesizing the polymer that reacts with a gelatin hardener to produce a high-molecular weight hardening agent is shown below.

SYNTHESIS 3

Poly-potassium vinylbenzenesulfinate-co-sodium acrylamido-2-methylpropanesulfonate (Q-1)

A 500-ml reactor is charged with 45.8 g of sodium acrylamido-2-methylpropanesulfonate, 20.6 g of potassium vinylbenzenesulfinate, 180 ml of ethanol and distilled water. The contents are heated to 75° C. under stirring and 0.82 g of [2,2'-azobis-(2-amine)propane]-dihydrochloride is added. After heating for 4 hours, the mixture is left to cool to room temperature, followed by addition of ethanol (72 ml) and distilled water (278 ml). Upon filtration, a colorless, transparent viscous liquid is obtained. This polymer solution has a viscosity of 3.25 centipoises (cPs) at 25° C., a solids content of 10.3 wt %, and a sulfinic acid content of $6.2\times10^{-6}$ equivalents/g.

Other high-molecular weight hardening agents can be readily synthesized in the light of the above-described examples of synthesis or the methods disclosed in the relevant patents listed herein. Some high-molecular weight hardening agents are also available commercially.

The choice of the amount in which the high-molecular weight hardening agent is used can be made in consideration of a specific object. Usually, the agent is added in such an amount that the content of the functional groups that react with a hydrophilic colloid such as gelatin is within the range of from $0.5\times10^{-3}$ to $5\times10^{-2}$ equivalents per 100 g of the hydrophilic colloid. A particularly preferable range is from $0.5\times10^{-3}$ to $2\times10^{-2}$ equivalents.

The high-molecular weight hardening agent described above may be used independently as a hardener. Alternatively, it may be used in combination with other high-molecular weight hardening agents or low-molecular weight hardening agents of the types described in Japanese Patent Application (OPI) Nos. 78788/1976, 41221/1978, 225143/1985, U.S. Pat. Nos. 3,325,287, 3,945,853, Japanese Patent Application (OPI) Nos. 31944/1984, 736/1980, 98741/1980, 46745/1980 and 130930/1979. The combined use is preferable for the purposes of the present invention. Examples of the compounds that can be used in combination with the high-molecular weight hardening agent described herein include: compounds that have a reactive halogen atom such as 2-hydroxy-4,6-dichloro-1,3,5-triazine; compounds having a reactive olefin such as divinyl sulfone; as well as isocyanates, aziridine compounds, epoxy compounds, mucochloric acid, chrome alum, and aldehydes. More specific examples are H-1 to H-21 which have been listed as illustrative gelatin hardeners that can be used to make the high-molecular weight hardening agent, Any silver halides that are conventionally used in silver halide emulsions such as silver bromide, silver iodobromide, silver iodochloride, silver chlorobromide, silver chloroiodobromide and silver chloride can be incorporated in the silver halide emulsion for use in the present invention. Of these silver halides, silver bromide, silver iodobromide and silver chloroiodobromide are preferred.

The silver halide grains to be used in the silver halide emulsions of the present invention may have a homogeneous structure throughout the crystal, or the structure of the core may be different from that of the shell.

These silver halide grains may be of the surface type where latent images are predominantly formed on the grain surface or of the internal type where latent images are formed within the grain.

The silver halide grains used in the silver halide emulsion in accordance with the present invention may have regular crystal shapes such as cubic, octahedral and tetra decahedral forms. The grains may have anomalous crystal shapes such as spherical and tabular forms. These grains may have any desired values for the ratio of (100) to (111) faces. The grains may have combinations of various crystal forms, or grains having different crystal forms may be used in mixture.

The average size of the silver halide grains used in the present invention is preferably within the range of 0.05~30 μm, within the range of 0.1~20 μm being more preferable.

The silver halide emulsion used in the present invention may have any pattern of grain size distribution, broad or narrow. Emulsions having a broad distribution (referred to as polydispersed emulsions) may be used. Also suitable for use, either independently or in combination, are emulsions having a narrow distribution (i.e., monodispersed emulsions which may be defined as those emulsions whose standard deviation of size distribution divided by the average grain size is no more than 0.20; the grain size is expressed as the diameter of a spherical grain and as the diameter of an equivalent circle for the projected area of a non-spherical grain). Polydispersed emulsions may be used in combination with monodispersed emulsions.

The silver halide emulsion of the present invention is chemically sensitized by an ordinary method, such as sulfur sensitization, selenium sensitization, reduction sensitization, or noble metal sensitization using gold and other noble metal compounds.

The silver halide emulsion of the present invention may be optically sensitized to a desired range of wavelength, using dyes known as sensitizing dye in the photographic industry. Sensitizing dyes may be employed either singly or in combination. Supersensitizers that are either dyes incapable of spectral sensitization by themselves or compounds substantially incapable of absorbing visible rays and which are capable of increasing the sensitizing effect of the sensitizing dyes may be incorporated in the photographic emulsion together with the sensitizing dyes.

Examplary sensitizing dyes used in the present invention include cyanine dyes, merocyanine dyes, complex cyanine dyes, complex merocyanine dyes, holopolar cyanine dyes, hemicyanine dyes, styryl dyes and hemioxanole dyes.

Particularly useful dyes are cyanine dyes, merocyanine dyes and complex merocyanine dyes.

The binder (or protective colloid) advantageously used in the silver halide emulsion of the present invention is gelatin, but other hydrophilic colloids such as gelatin derivatives, graft polymers of gelatin with other polymers, proteins, sugar derivatives, cellulose derivatives, and synthesized hydrophilic high-molecular weight substances such as homo- or copolymers may be used.

A plasticizer may be added to the silver halide emulsion layer(s) and/or other hydrophilic colloidal layer(s) in the light-sensitive material of the present invention in order to enhance their flexibility. Compounds which are preferably used as such plasticizers are described in Research Disclosure (RD) No. 17643, XII, A.

A water-insoluble or slightly water-soluble synthetic polymer dispersion (i.e., latex) may also be incorporated in the photographic emulsion layer(s) and other hydrophilic colloidal layer(s) in the light-sensitive material of the present invention in order to improve the dimensional stability of these layers.

Exemplary polymers that can be used in the present invention include those that have as monomer contents alkyl(meth)acrylate, alkoxyalkyl(meth)acrylate, glycidyl(meth)acrylate, (meth)acrylamide, a vinyl ester (e.g., vinyl acetate), acrylonitrile, olefin and styrene, either singly or in combination with each other or with acrylic acid, methacrylic acid, α,β-unsaturated dicarboxylic acid, hydroxyalkyl(meth)acrylate, sulfoalkyl(meth)acrylate and styrenesulfonic acid.

The emulsion layers in the photographic material of the present invention contain a dye forming coupler that will, in color development, enter into coupling with the oxidized product of an aromatic primary amino developing agent (e.g., p-phenylenediamine derivative or aminophenol derivative) to form a dye. A suitable dye forming coupler usually is selected for each emulsion layer so that it will form a dye that absorbs light in the spectral range of sensitivity for each emulsion layers; a yellow dye forming coupler is used in a blue-sensitive emulsion layer; a magenta dye forming coupler is used in a green-sensitive emulsion layer; and a cyan dye forming coupler is used in a red-sensitive emulsion layer. Other combinations of coupler and emulsions may be employed if such are needed for particular silver halide color photographic materials.

The aforementioned dye forming couplers desirably contain in their molecules a ballast group of 8 or more carbon atoms that will render the couplers non-diffusible. These dye forming couplers may be of the four-equivalent type that requires the reduction of four silver ions for the formation of one molecule of a dye, or of the two-equivalent type that needs the reduction of two silver ions. The dye forming couplers include a compound that will, upon coupling with the oxidized product of a developing agent, release a photographically useful fragment such as development restrainer, development accelerator, bleach accelerator, developing agent, silver halide solvent, tone conditioner, hardener, fogging agent, antifoggant, chemical sensitizer, spectral sensitizer or desensitizer.

Among these compounds are DIR compounds which release a development retarder as a function of development to improve the sharpness or granularity of image. The DIR coupler may be replaced by a DIR compound that will couple with the oxidized product of a developing agent not only to form a colorless compound by also to release a development retarder.

Two types of DIR coupler and DIR compound are usable: one is of the type wherein a retarder is directly bonded to the coupling site, and the other is referred to as a timing DIR coupler or a timing DIR compound wherein the retarder is bonded to the coupling site by a divalent group in such a manner that said retarder will be released as by intramolecular nucleophilic or electron transfer reaction within the group that leaves upon coupling reaction. A retarder that becomes diffusible upon leaving and one that is not highly diffusible may be used either singly or in combination depending on the need. They may also be used in combination with a competing coupler, or a colorless coupler that couples with the oxidized product of an aromatic primary amino developing agent but which will not form any dye.

Known acyl acetanilide based couplers may preferably be used as yellow dye forming couplers in the present invention. Benzoyl acetanilide and pivaloyl acetanilide based compounds are advantageous.

The magenta-dye forming couplers that can be used in the present invention include known couplers such as 5-pyrazolone couplers, pyrazolo-benzimidazole couplers, pyrazolotriazole couplers, open-chain acylacetonitrile couplers and indazolone couplers.

Phenol- or naphthol-based couplers are generally used for cyan-dye forming couplers.

The high-boiling organic solvent is one having a boiling point not lower than 150° C. that does not react with the oxidized product of a developing agent, such as a phenol derivative, an alkyl phthalate ester, a phosphate ester, a citrate ester, a benzoate ester, an alkylamide, a fatty acid ester or a trimesic acid ester.

Low-boiling solvents or water-soluble organic solvents may be used together with, or instead of high-boiling solvents. Illustrative low-boiling organic solvents that are substantially water-insoluble include ethyl acetate, propyl acetate, butyl acetate, butanol, chloroform, carbon tetrachloride, nitromethane, nitroethane and benzene.

The hydrophilic colloidal layers such as protective layers and intermediate layers in the light-sensitive material of the present invention may contain antifoggants serving to prevent the occurrence of fogging due to discharge resulting from the light-sensitive material being charged by friction or other causes, or UV absorbers for preventing the deterioration of image due to UV radiation.

Silver halide emulsion layers and/or other hydrophilic colloidal layers in the light-sensitive material of the present invention may contain matting agents for the purpose of reducing its gloss, increasing its adaptability to writing with a pencil, or preventing its adhesion to an adjacent light-sensitive material. Exemplary matting agents include silicon dioxide, titanium dioxide, magnesium dioxide, aluminum dioxide, barium sulfate, calcium carbonate, acrylic acid and methacrylic acid polymers and esters thereof, polyvinyl resins, polycarbonate and styrene polymers and copolymers thereof.

The matting agents preferably have grain sizes of 0.05 to 10 μm, and are preferably added in amounts ranging from 1 to 300 mg/m$^2$.

The light-sensitive material of the present invention may contain a lubricant that is capable of reducing its sliding friction.

The light-sensitive material may also contain an antistat for the purpose of preventing static buildup. The antistat may be incorporated in an antistatic layer on the side of the support where no emulsion layer is formed. Alternatively, the antistat may be incorporated in an emulsion layer and/or a protective layer. Compounds that are preferably used as antistats are described in RD No. 17643, XIII.

Photographic emulsion layers and/or other hydrophilic colloidal layers in the light-sensitive material of the present invention may contain a variety of surfactants for attaining such purposes as improved coating property, prevention of antistatic buildup, improved slipping property, emulsification/dispersion, antiblocking and improved photographic characteristics in terms of accelerated development, hard tone and sensitization.

A thickener may be used in order to facilitate the coating operation performed for producing the photographic material of the present invention. There are additives such as hardeners which are reactive enough to cause premature gelling if they are preliminarily incorporated in the coating fluid. Such reactive additives are preferably mixed with the other components by means of a suitable device such as a static mixer just before the start of coating operation.

Particularly useful coating techniques are extrusion coating and curtain coating, both of which will enable simultaneous application of two or more layers. Bucket coating may be employed if a specific object permits. The coating speed may be selected at any desirable value.

The surfactants to be used in the present invention are not particularly limited, but exemplary surfactants include natural surfactants such as saponin; nonionic surfactants such as alkyleneoxide-, glycerin- and glycidol-based surfactants; cationic surfactants such as higher alkylamines, quaternary ammonium salts, heterocyclic compounds (e.g., pyridine), phosphonium and sulfonium compounds; anionic surfactants containing acidic groups such as carboxylic acid, sulfonic acid, phosphoric acid, sulfate esters and phosphate esters; and amphoteric surfactants such as amino acids, aminosulfonic acids, sulfate or phosphate esters of aminoalcohol.

The silver halide photographic material of the present invention is free from the problem of the above-specified organic fluoro-compound or nonionic surfactant dissolving out into processing solutions to cause sludge formation or foul transport rollers. As a result, the photographic material of the present invention permits the use of such compounds in sufficiently large amounts to ensure satisfactory antistatic and antiblocking effects. This photographic material has the additional advantage that it will not experience any drop in sensitivity since unlike the conventional product, a photographic layer containing the organic fluoro-compound and/or nonionic surfactant can be hardened without causing undue hardening of silver halide emulsion layers.

The following examples are provided for the purpose of further illustrating the present invention but are in no way intended to limit the scope of the invention. Unless otherwise noted, the amounts of components in each of the silver halide photographic materials prepared in the following examples are calculated for square meter. The amounts of silver halide and colloidal silver are expressed in terms of silver.

EXAMPLE 1

A sample of multilayered color photographic material was prepared by coating a triacetyl cellulose film support with twelve layers having the compositions shown below, wherein the layer arrangement is indicated in order from the support side. The prepared sample is designated sample No. 1.

First layer: anti-halation layer Gelatin layer containing black colloidal silver (gelatin content, 2.2 g/m$^2$)

Second layer: intermediate layer Gelatin layer containing an emulsified dispersion of 2,5-di-t-octylhydroquinone (gelatin content, 1.2 g/m$^2$)

Third layer: less red-sensitive silver halide emulsion alyer

Components:

monodispersed emulsion (Em-I) with an average grain size ($\bar{r}$) of 0.30 μm which was formed of AgBrI with 6 mol % AgI (silver deposit, 1.8 g/m$^2$);

sensitizing dye I ($6\times10^{-5}$ moles per mole of silver);

sensitizing dye II ($1.0\times10^{-5}$ moles per mole of silver);
cyan coupler (C-1) (0.06 moles per mole of silver);
colored cyan coupler (CC-1) (0.003 moles per mole of silver);
DIR compound (D-1) (0.0015 moles per mole of silver);
DIR compound (D-2) (0.002 moles per mole of silver);
(gelatin content, 1.4 g/m$^2$)

Fourth layer: highly red-sensitive silver halide emulsion layer
Components:
monodispersed emulsion (Em-II) with an average grain size ($\bar{r}$) of 0.5 μm which was formed of AgBrI with 7.0 mol % AgI (silver deposit, 1.3 g/m$^2$);
sensitizing dye I ($3\times10^{-5}$ moles per mole of silver);
sensitizing dye II ($1.0\times10^{-5}$ moles per mole of silver);
cyan coupler (C-1) (0.02 moles per mole of silver);
colored cyan coupler (CC-1) (0.0015 moles per mole of silver);
DIR compound (D-2) (0.001 mole per mole of silver);
(gelatin content, 1.0 g/m$^2$)

Fifth layer: intermediate layer
Same as the second layer (gelatin content, 1.0 g/m$^2$)

Sixth layer: less green-sensitive silver halide emulsion layer
Components:
Em-1 (silver deposit, 1.5 g/m$^2$);
sensitizing dye III ($2.5\times10^{-5}$ moles per mole of silver);
sensitizind dye IV ($1.2\times10^{-5}$ moles per mole of silver)
magenta coupler (M-1) (0.050 moles per mole of silver);
colored magenta coupler (CM-1) (0.009 moles per mole of silver);
DIR compound (D-1) (0.0010 mole per mole of silver);
DIR compound (D-3) (0.0030 moles per mole of silver);
(gelatin content, 2.0 g/m$^2$)

Seventh layer: highly green-sensitive silver halide emulsion layer
Components:
Em-II (silver deposit, 1.4 g/m$^2$);
sensitizing dye III ($1.5\times10^{-5}$ moles per mole of silver);
sensitizing dye IV ($1.0\times10^{-5}$ mole per mole of silver);
magenta coupler (M-1) (0.020 moles per mole of silver);
colored magenta coupler (CM-1) (0.002 moles per mole of silver);
DIR compound (D-3) (0.0010 mole per mole of silver);
(gelatin content, 1.8g/m$^2$)

Eighth layer: yellow filter layer (YC-1)
Gelatin layer containing yellow colloidal silver and an emulsified dispersion of 2,5-di-t-dioctylhydroquinone
(gelatin content, 1.5 g/m$^2$)

Ninth layer: less blue-sensitive silver halide emulsion layer
Components:
monodispersed emulsion (Em-III) with an average grain size of 0.48 μm which was formed of AgBrI with 6 mol % AgI (silver deposit, 0.9 g/m$^2$)
sensitizing dye V ($1.3\times10^{-5}$ moles per mole of silver)
yellow coupler (Y-1) (0.29 moles per mole of silver);
(gelatin content, 1.9 g/m$^2$)

Tenth layer: highly blue-sensitive silver halide emulsion layer
Components:
monodispersed emulsion (Em-IV) with an average grain size of 0.8 μm which was formed of AgBrI with 15 mol % AgI (silver deposit, 0.5 g/m$^2$) sensitizing dye V ($1.0\times10^{-5}$ mole per mole of silver);
yellow coupler (Y-1) (0.08 moles per mole of silver);
DIR compound (D-2) (0.0015 moles per mole of silver);
(gelatin content, 1.6 g/m$^2$)

Eleventh layer: first protective layer
Gelatin layer containing AgBrI (1 mol % AgI; average grain size, 0.07 μm; silver deposit, 0.5 g/m$^2$), UV absorbers, UV-1 and UV-2
(gelatin content, 1.2 g/m$^2$)

Twelfth layer: second protective layer
Gelatin layer containing: polymethyl methacrylate particles (dia.=1.5 μm);
particles of ethyl methacrylate/methyl methacrylate/methacrylic acid copolymer (average size=2.5 μm);
organic fluoro-compound of the present invention (see Table 1);
high-molecular weight hardening agent of the present invention (see Table 1);
low-molecular weight hardening agent (H-7) ($2.5\times10^{-3}$ eq./100 g of gelatin); and formaldehyde scavenger (HS-1)
(gelatin content, 1.2 g/m$^2$)

Sample Nos. 2 to 13 were prepared by changing the organic fluoro-compound and high-molecular weight hardening agent in the 12th layer of sample No. 1 to those indicated in Table 1.

The compounds incorporated in layers 1 to 11 are shown more specifically below.

Sensitizing dye I: anhydro-5,5'-dichloro-9-ethyl-3,3'-di-(3-sulfopropyl)thiacarbocyanine hydroxide
Sensitizing dye II: anhydro-9-ethyl-3,3'-di-(3-sulfopropyl)-4,5,4',5'-dibenzothiacarbocyanine hydroxide
Sensitizing dye III: anhydro-5,5'-diphenyl-9-ethyl-3,3'-di-(3-sulfopropyl)oxacarbocyanine hydroxide
Sensitizing dye IV: anhydro-9-ethyl-3,3'-di-(3-sulfopropyl)-5,6,5',6'-dibenzoxacarbocyanine hydroxide
Sensitizing dye V: anhydro-3,3'-di-(3-sulfopropyl)-4,5-benzo-5'-methoxythiacyanine

C-1

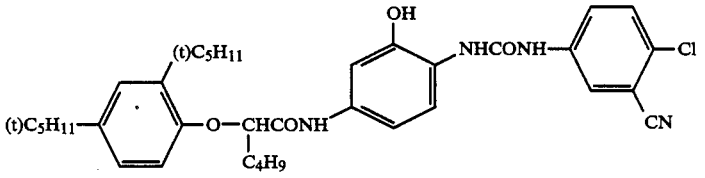

-continued
CC-1
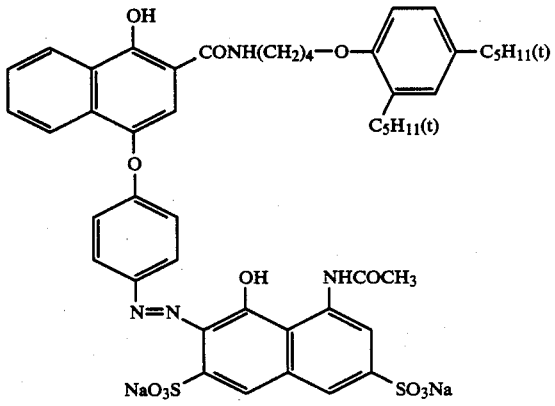
D-1
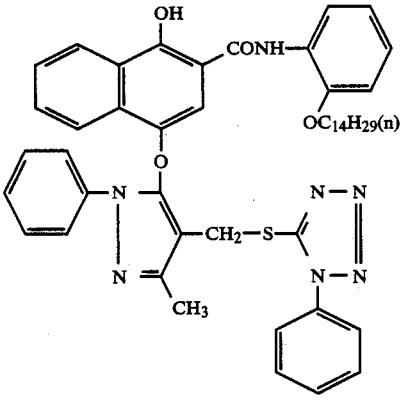
D-2
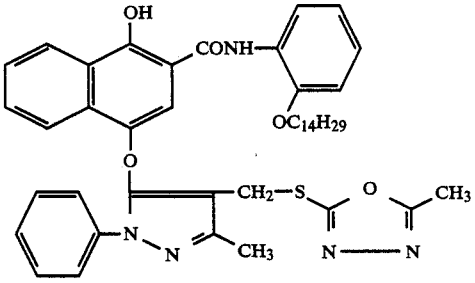
D-3
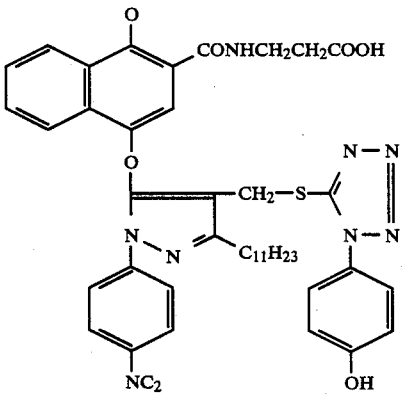

-continued

M-1

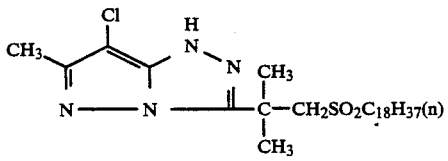

CM-1

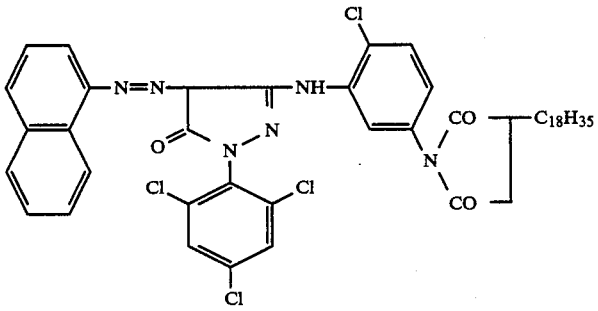

Y-1

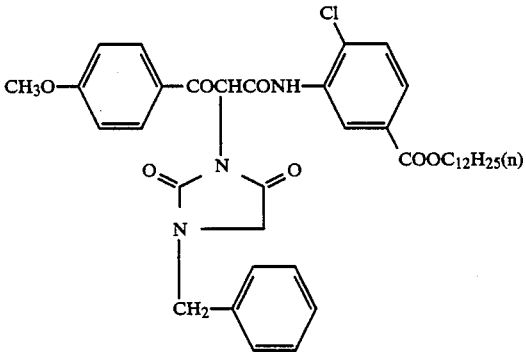

UV-1

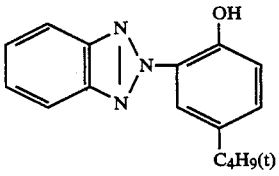

UV-2

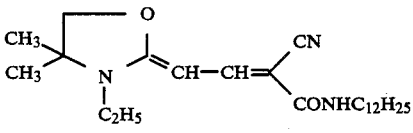

HS-1

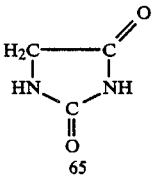

Antiblocking property

Two test pieces (5×5 cm) were cut from each sample and stored, while kept apart, for one day at 23° C. and at 80% r.h. The two test pieces of the same sample were then brought into contact with each other and stored in a hot and humid atmosphere (40° C.×80% r.h.) under a load of 800 g. Thereafter, the test pieces were peeled apart and the area over which they had stuck to each other was measured in order to evaluate the antiblocking property of the sample.

The following criteria were used:

| Rating | Blocking area |
|---|---|
| A | 0–20% |
| B | 21–40% |
| C | 41–60% |
| D | ≧61% |

The results are shown in Table 1.

Sludge formation

Each of the samples was cut to 50 films of a given size (30.5×17.1 cm), which were continuously processed in accordance with the scheme to be shown below. The processing solutions were then checked for the presence of any sludge.

Sensitivity

After being exposed to white light through an optical wedge, each of the samples were processed by the scheme to be shown below and their sensitivities were compared. Sensitivity is the reciprocal of the amount of exposure necessary to attain a density of (fog+0.5) and is expressed in terms of relative values, with the value for Comparative Sample 11 being taken as 100. The results are shown in Table 1.

Antistatic property

An unexposed sample was conditioned at 25° C. and 25% r.h. for 2 hours. The sample was transferred to a dark place having the same atmospheric condition (25° C.×25% r.h.) and the emulsion-coated surface of the sample were rubbed by passage between neoprene rubber rollers. Thereafter, the sample was developed, bleached, fixed, washed and stabilized as indicated below. The severity of the occurrence of static marks on the processed sample was examined.

The following criteria were used in evaluating the severity of static mark generation:

A: no static mark;

B: a few static marks;

C: extensive static marks;

D: static marks developed in almost the entire surface of the sample.

The results are shown in Table 1.

| Processing steps (38° C.) | Time |
|---|---|
| Color development | 3 min and 15 sec |
| Bleaching | 6 min and 30 sec |
| Washing | 3 min and 15 sec |
| Fixing | 6 min and 30 sec |
| Washing | 3 min and 15 sec |
| Stabilizing | 1 min and 30 sec |

The following processing fluids were used.

| | |
|---|---|
| Color developing solution | |
| 4-Amino-3-methyl-N-ethyl-N-(8-hydroxy-ethyl)-aniline sulfate | 4.75 g |
| Anhydrous sodium sulfite | 4.25 g |
| Hydroxylamine hemisulfate | 2.0 g |
| Anhydrous potassium carbonate | 37.5 g |
| Sodium bromide | 1.3 g |
| Nitrilotriacetic acid trisodium salt (monohydrate) | 2.5 g |
| Potassium hydroxide | 1.0 g |
| Water to make | 1,000 ml |
| Bleaching solution | |
| Ethylenediaminetetraacetic acid iron (II) ammonium salt | 100.0 g |
| Ethylenediaminetetraacetic acid diammonium salt | 10.0 g |
| Ammonium bromide | 150.0 g |
| Glacial acetic acid | 10.0 ml |
| Water to make | 1,000 ml |
| pH adjusted to 6.0 with aqueous ammonia | |
| Fixing solution | |
| Ammonium thiosulfate (50% aq. sol.) | 175 ml |
| Anhydrous sodium sulfite | 8.5 g |
| Sodium metasulfite | 2.3 g |
| Water to make | 1,000 ml |
| pH adjusted to 6.0 with acetic acid | |
| Stabilizing solution | |
| Formaldehyde (37% aq. sol.) | 1.5 ml |
| Konidax (Konishiroku Photo Industry Co., Ltd.) | 7.5 ml |
| Water to make | 1,000 ml |

TABLE 1

| | Sample No. | High-molecular weight hardening agent name | High-molecular weight hardening agent amount ($\times 10^{-3}$ eq./100 g of gelatin | Organic fluoro-compound (mg/m$^2$) | Antiblocking property | Sensitivity | Sludge formation | Severity of static mark generation |
|---|---|---|---|---|---|---|---|---|
| Samples of the invention | 1 | HP-2 | 1.7 | F-2 (20) | A | 101 | negative | A |
| | 2 | HP-3 | 1.8 | F-4 (20) | A | 100 | " | A |
| | 3 | HP-3 | 1.8 | F-8 (20) | A | 101 | " | A |
| | 4 | HP-3 | 1.8 | F-9 (20) | A | 103 | " | A |
| | 5 | HP-4 | 1.7 | F-11 (20) | A | 99 | " | A |
| | 6 | HP-4 | 1.7 | F-20 (20) | A | 100 | " | A |
| | 7 | HP-6 | 1.8 | F-34 (20) | A | 100 | " | A |
| | 8 | HP-7 | 1.8 | F-9 (20) | A | 100 | " | A |
| | 9 | HP-14 | 1.8 | F-42 (20) | A | 101 | " | A |
| | 10 | HP-21 | 1.8 | F-46 (20) | A | 101 | " | A |
| Comparative samples | 11 | — | — | F-9 (20) | B | 100 | positive after 30 runs | B |
| | 12 | — | — | F-9 (20) | C | 103 | negative | C |
| | 13* | — | — | F-9 (20) | A | 72 | " | A |

*The 12th layer contained H-7 (low-molecular weight hardening agent) in an amount of 5 × $10^{-3}$ equivalents/100 g of gelatin.

As one can see from Table 1, sample No. 11 that contained an organic fluoro-compound but not a high-molecular weight hardening agent caused sludge formation in processing solutions as a result of dissolution of the organic fluoro-compound. This sample was also unsatisfactory in terms of both antiblocking and antistatic performances Sample No. 12 containing the organic fluoro-compound in a smaller amount was free from the sludge problem but it was still unsatisfactory in terms of antiblocking and antistatic properties. Sample No. 13 contained twice the amount of H-7 (low-molecular weight hardening agent) compared with the other samples. In this sample, the layer containing the organic fluoro-compound was hardened by a sufficient degree to prevent sludge formation while providing good antiblocking and antistatic performances. On the other hand, the silver halide emulsion layers were excessively hardened to suffer a marked drop in sensitivity.

Compared with these samples, sample Nos. 1 to 10 of the present invention exhibited satisfactory antiblocking and antistatic effects and were yet free from the problems of sludge formation and drop in sensitivity.

satisfactory antiblocking and antistatic effects while causing no sludge formation.

TABLE 2

| | Sample No. | Hardening agent: high mol. wt. hardener providing polymer ($\times 10^{-3}$ eq./100 g of gelatin) | Hardening agent: low mol. wt. hardener ($\times 10^{-3}$ eq./100 g of gelatin) | Organic fluoro-compound ($mg/m^2$) | Antiblocking property | Severity of static mark generation | Sludge formation |
|---|---|---|---|---|---|---|---|
| Samples of the invention | 14 | Q-2 (2.1) | H-6 (2.5) | F-2 (20) | A | A | negative |
| | 15 | Q-2 (2.1) | H-6 (2.5) | F-4 (20) | B | A | " |
| | 16 | Q-2 (2.1) | H-6 (2.5) | F-8 (20) | A | A | " |
| | 17 | Q-2 (2.1) | H-6 (2.5) | F-9 (20) | A | A | " |
| | 18 | Q-2 (2.1) | H-6 (2.5) | F-11 (20) | B | B | " |
| Comparative samples | 19 | — | H-6 (2.5) | F-9 (20) | B | B | positive after 30 runs |
| | 20 | — | H-6 (2.5) | F-9 (10) | D | C | negative |

EXAMPLE 2

Samples were prepared as in Example 1 except that H-7 as a low-molecular weight hardening agent was replaced by an equivalent amount of H-6 and that Q-2 was used as a polymer that would provide a high-molecular weight hardening agent. The prepared samples were subjected to the same evaluations as conducted in Example 1. The results are shown in Table 2.

As one can see from Table 2, the objects of the present invention can also be attained by using a high-molecular weight hardening agent that is prepared from a polymer that reacts with a low-molecular weight hardening agent to provide the desired high-molecular weight hardening agent. As is evident from Table 2, sample Nos. 14 to 18 of the present invention displayed

EXAMPLE 3

Samples of x-ray photographic material were prepared by coating both sides of subbed polyethylene terephthalate supports with three layers having the compositions indicated below, wherein the layer arrangement is shown in order from the support side. Unless otherwise noted, the amount indicated below of each of the additives other than silver halides is based on one mole of silver halide.

| | | |
|---|---|---|
| First layer: | crossover cutting layer containing 3 $mg/m^2$ of dye (I) | |
| | gelatin layer containing 0.2 $g/m^2$ of gelatin | |
| Second layer: | emulsion layer comprising an emulsion that was made of AgBrI (1.5 mol % AgI; average grain size, 1.2 μm) and which was coated for a silver deposit of 4 $g/m^2$; the other components are listed below: | |
| | 4-hydroxy-6-methyl-1,3,3a,7-tetrazaindene | (1.2 g) |
| | diethylene glycol | (11.0 g) |
| | paranitrophenyl triphenyl phosphide chloride | (0.2 g) |
| | gelatin | (2.5 $g/m^2$) |
| Third layer: | protective layer containing the following ingredients: | |
| | sodium diethylhexylsulfosuccinate | (0.015 $g/m^2$) |
| | glyoxal | (0.02 $g/m^2$) |
| | mucochloric acid | (0.015 $g/m^2$) |
| | polymethyl methacrylate particles (average size, 3–4 μm) | (50 $mg/m^2$) |
| | gelatin | (0.9 $g/m^2$) |
| | organic fluoro-compound within the scope of the invention | (600 $mg/m^2$) |
| | high-molecular weight hardening agent within the scope of the invention | ($1.8 \times 10^{-3}$ eq./100 g gelatin) |

-continued

Dye (I)

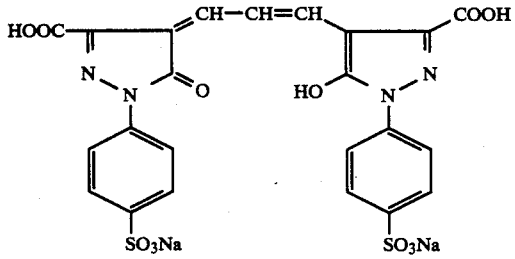

The samples prepared were subjected to the same evaluations as conducted in Example 1. The processing scheme employed was as follows. The results of evaluations are shown in Table 3.

| Steps | Temperature | Time |
|---|---|---|
| development | 30° C. | 45 sec |
| fixing | 25° C. | 35 sec |
| washing | 15° C. | 35 sec |
| drying | 45° C. | 20 sec |
| Developer | | |
| Phenidone | | 0.4 g |
| Methol | | 5 g |
| hydroquinone | | 1 g |
| sodium anhydrous sulfite | | 60 g |
| sodium carbonate (hydrate) | | 54 g |
| 5-nitroimidazole | | 0.1 g |
| potassium bromide | | 2.5 g |
| water to make | | 1,000 ml |
| pH adjusted to 10.20 | | |
| Fixing solution | | |
| Part A: | | |
| ammonium thiosulfate | | 170 g |
| sodium sulfite | | 15 g |
| boric acid | | 6.5 g |
| glacial acetic acid | | 12 ml |
| sodium citrate (dihydrate) | | 2.5 g |
| water to make | | 275 ml |
| Part B: | | |
| aluminum sulfate | | 15 g |
| 98% sulfuric acid | | 2.5 g |
| water to make | | 40 ml |

When used, 275 ml of part A was mixed with 40 ml of part B and water was added to the mixture to make 1,000 ml.

TABLE 3

| | Sample No. | High-molecular weight hardener | Organic fluoro-compound (mg/m²) | Antiblocking property | Severity of static mark generation | Sludge formation |
|---|---|---|---|---|---|---|
| Samples of the invention | 21 | HP-2 | F-2 (600) | A | A | negative |
| | 22 | HP-3 | F-4 (600) | A | A | " |
| | 23 | HP-3 | F-8 (600) | A | A | " |
| | 24 | HP-3 | F-9 (600) | A | A | " |
| | 25 | HP-3 | F-11 (600) | A | A | " |
| | 26 | HP-7 | F-8 (600) | A | A | " |
| | 27 | HP-7 | F-9 (600) | A | A | " |
| | 28 | HP-14 | F-9 (600) | A | A | " |
| Comparative samples | 29 | — | F-9 (600) | B | B | positive after 10 runs |
| | 30 | — | F-9 (300) | C | D | negative |

As one can see from Table 3, the present invention is also applicable to X-ray photographic materials since sample Nos. 21 to 28 of the present invention displayed good antistatic and antiblocking effects while causing no sludge formation.

EXAMPLE 4

(1) Preparation of samples

A subbed polyethylene terephthalate film support (180 μm) was coated with a silver halide emulsion layer having the formulation indicated below. A protective layer having the composition also shown below was formed on the applied silver halide emulsion layer. The assembly was dried to make a black-and-white silver halide photographic material. The protective layer had incorporated therein a nonionic surfactant (N-4) and a high-molecular weight hardening agent (HP-2) within the scope of the present invention, as well as a low-molecular weight hardening agent (H-9) that was present in an amount of $2\times10^{-3}$ eq./100 g of gelatin.

| | | |
|---|---|---|
| Emulsion layer | | |
| Thickness: | 5 μm | |
| Composition: | gelatin | 2.5 g/m² |
| | AgBrI (1.5 mol % AgI) | 5 g/m² |
| | 1-phenyl-5-mercapto-tetrazole | 25 mg/m² |
| Protective layer | | |
| Thickness: | ca. 1 μm | |
| Composition: | gelatin | 0.9 g/m² |
| | 2,6-dichlor-6-hydroxy-1,3,5-triazine sodium salt | 10 mg/m² |
| | polyethy acrylate latex | 0.8 g/m² |
| | nonionic surfactant (N-4) | 40 mg/m² |
| | antistat within the scope of the invention ($C_8F_{17}SO_2N(C_2H_5)CH_2COOK$) | 4 mg/m² |
| | polymethyl methacrylate (matting agent with an average particle size of 3 μm) | 37 mg/m² |

Besides the sample thus prepared (sample No. 31), sample Nos. 32 to 42 that were also within the scope of the present invention were prepared by the same method as described above except that the nonionic surfactant and high-molecular weight hardening agent were changed to those indicated in Table 4. Comparative sample Nos. 43 and 44 were prepared and they contained a nonionic surfactant and an organic fluoro-compound but did not contain a high-molecular weight hardening agent. Control sample No. 45 was also prepared; it did not contain any nonionic surfactant, organic fluoro-compound or high-molecular weight hardening agent.

(2) Evaluation of antistatic performance

Evaluation of antistatic performance was made on the basis of the generation of static marks. A test of generating static marks was carried out by the following method: an unexposed sample of photographic material was placed on a rubber sheet, with the surface of the layer containing a nonionic surfactant facing down; the top of this photographic material was compressed with a rubber roller and the sample was peeled away form the rubber sheet so as to generate static marks. This test was conducted at 25° C. and 25% r.h. after the test pieces had been conditioned for 24 hours under the conditions just mentioned. Severity of the generation of static marks on each sample was determined after it had been developed for 5 minutes at 20° C. with a developing solution having the composition justed noted below:

| Developing solution | |
|---|---|
| N-methyl-p-aminophenol sulfate | 4 g |
| Anhydrous sodium sulfite | 60 g |
| Hydroquinone | 10 g |
| Sodium carbonate (monohydrate) | 53 g |
| Potassium bromide | 25 g |
| Water to make | 1,000 ml |

The following five criterion were used in evaluating the generation of static marks:

A: no static mark;

B: a few static marks;

C: many static marks;

D: extensive static marks;

E: static marks developed in almost the entire surface of the sample.

(3) Testing photographic sensitivity

Each of the samples was exposed under a tungsten lamp and developed (35° C.×30 sec) with a developer having the composition indicated below. After fixing and washing, the photographic sensitivity of each sample was determined.

| Developer | |
|---|---|
| Lukewarm water | 800 ml |
| Sodium tetrapolyphosphate | 2.0 g |
| Anhydrous sodium sulfite | 50 g |
| Hydroquinone | 10 g |
| Sodium carbonate (monohydrate) | 40 g |
| 1-Phenyl-3-pyrazolidone | 0.3 g |
| Potassium bromide | 2.0 g |
| Water to make | 1,000 ml |

(4) Evaluating the fouling of rollers

Each of the samples having an emulsion layer and a surface protective layer was cut to pieces of a given size (30.5×17.1 cm). These test pieces were uniformly exposed so that they would attain an optical density of 1.0 after processing. Following the exposure, 50 pieces were continuously processed in an automatic developer (having silicone transport rollers and consisting of three baths—development, fixing and washing). After thoroughly drying the squeeze rollers, one more test piece was processed and checked for any unevenness in image density that would have occurred as streaks at the leading edge of that sample.

The following four criteria were used in evaluating the severity of the fouling of rollers:

A: no unevenness in image density

B: small unevenness in image density

C: extensive unevenness in image density

D: very extensive unevenness in image density.

The results are shown in Table 4 below.

TABLE 4

| | Sample No. | High-molecular weight hardener name | High-molecular weight hardener amount ($\times 10^{-3}$ eq./100 g of gelatin) | Nonionic surfactant | Severity of static mark generation | Fouling of rollers | Photographic sensitivity* |
|---|---|---|---|---|---|---|---|
| Samples of the invention | 31 | HP-2 | 1.7 | N-4 | A | A | 100 |
| | 32 | HP-3 | 1.8 | N-13 | A | A | 98 |
| | 33 | HP-3 | 1.8 | N-20 | A | A | 99 |
| | 34 | HP-3 | 1.8 | N-23 | A | A | 100 |
| | 35 | HP-3 | 1.8 | N-25 | A | A | 100 |
| | 36 | HP-3 | 1.8 | N-31 | A | A | 100 |
| | 37 | HP-4 | 1.7 | N-23 | A | A | 100 |
| | 38 | HP-4 | 1.7 | N-28 | A | A | 99 |
| | 39 | HP-4 | 1.7 | N-31 | A | A | 100 |
| | 40 | HP-6 | 1.8 | N-23 | A | A | 100 |
| | 41 | HP-7 | 1.8 | N-24 | A | A | 100 |
| | 42 | HP-14 | 1.7 | N-31 | A | A | 100 |
| (comparison) | 43 | — | — | N-23 | A | C | 99 |
| (comparison) | 44 | — | — | N-31 | A | C | 99 |
| (Control) | 45 | — | — | — | E | A | 100 |

*In relative values, with the value for sample No. 45 being taken as 100.

As one can see from Table 4, control sample No. 45 containing none of the nonionic surfactant, organic fluorocompound and hardening agent specified by the present invention was affected by static marks that appeared on its entire surface. Comparative sample Nos.

43 and 44 contained N-23 and N-31, respectively, as nonionic surfactants, in addition to an organic fluoro-compound within the scope of the present invention. But they did not contain any of the high-molecular weight hardening agents specified by the present invention. Although these samples (Nos. 43 and 44) were free from the generation of static marks, they experienced extensive unevenness in image density due to the fouling of transport rollers. Sample Nos. 31 to 42 of the present invention contained nonionic surfactants and high-molecular weight hardening agents within the scope of the present invention, in addition to an organic fluoro-compound that was also within the scope of the present invention. None of these samples was affected by static marks and they were free from the problem of unevenness in image density due to the fouling of transport rollers. Further, the addition of surfactants to these samples did not cause any drop in their photographic sensitivity

EXAMPLE 5

(1) Preparation of samples

A subbed polyethylene terephthalate film support (180 μm) was coated with a silver halide emulsion layer having the formulation indicated below. A protective layer having the composition also shown below was formed on the applied silver halide emulsion layer. The assembly was dried to make a black-and-white silver halide photographic material. The protective layer had incorporated therein a nonionic surfactant (N-4) and a high-molecular weight hardening agent (HP-2) within the scope of the present invention, as well as a low-molecular weight hardening agent (H-9) that was present in an amount of $2\times10^{-3}$ eq./100 g of gelatin.

| | | |
|---|---|---|
| Emulsion layer | | |
| Thickness: | 5 μm | |
| Composition: | gelatin | 2.5 g/m$^2$ |
| | AgBrI (1.5 mol % AgI) | 5 g/m$^2$ |
| | 1-phenyl-5-mercapto-tetrazole | 25 mg/m$^2$ |
| Protective layer | | |
| Thickness: | ca. 1 μm | |
| Composition: | gelatin | 0.9 g/m$^2$ |
| | 2,6-dichlor-6-hydroxy-1,3,5-triazine sodium | 10 mg/m$^2$ |

-continued

| | | |
|---|---|---|
| | salt | |
| | polyethyl acrylate latex | 0.8 g/m$^2$ |
| | nonionic surfactant (N-4) | 70 mg/m$^2$ |
| | polymethyl methacrylate (matting agent with an average particle size of 3 um) | 37 mg/m$^2$ |

Besides the sample thus prepared (sample No. 46), sample Nos. 47 to 57 that were also within the scope of the present invention were prepared by the same method as described above except that the nonionic surfactant and high-molecular weight hardening agent were changed to those indicated in Table 5. Comparative sample Nos. 58 and 59 were prepared and they contained a nonionic surfactant but did not contain a high-molecular weight hardening agent. Control sample No. 60 was also prepared; it contained neither a nonionic surfactant nor a high-molecular weight hardening agent.

TABLE 5

| | Sample No. | High-molecular weight hardener name | amount ($\times 10^{-3}$ eq./100 g of gelatin) | Nonionic surfactant | Severity of static mark generation | Fouling of rollers | Photographic sensitivity* |
|---|---|---|---|---|---|---|---|
| Samples of the invention | 46 | HP-2 | 1.7 | N-4 | A | A | 100 |
| | 47 | HP-3 | 1.8 | N-13 | A | A | 98 |
| | 48 | HP-3 | 1.8 | N-20 | A | A | 99 |
| | 49 | HP-3 | 1.8 | N-23 | A | A | 99 |
| | 50 | HP-3 | 1.8 | N-25 | A | A | 99 |
| | 51 | HP-3 | 1.8 | N-31 | A | A | 99 |
| | 52 | HP-4 | 1.7 | N-23 | A | A | 100 |
| | 53 | HP-4 | 1.7 | N-28 | A | A | 99 |
| | 54 | HP-4 | 1.7 | N-31 | A | A | 99 |
| | 55 | HP-6 | 1.8 | N-23 | A | A | 100 |
| | 56 | HP-7 | 1.8 | N-24 | A | A | 100 |
| | 57 | HP-14 | 1.7 | N-31 | A | A | 99 |
| (comparison) | 58 | — | — | N-23 | B | C | 99 |
| (comparison) | 59 | — | — | N-31 | A | C | 99 |
| (Control) | 60 | — | — | — | E | A | 100 |

In relative terms, with the value for sample No. 60 being taken as 100.

As one can see from Table 5, control sample No. 60 containing neither a high-molecular weight hardening agent nor a nonionic surfactant was affected by static marks that appeared on its entire surface. Comparative sample Nos. 58 and 59 contained N-23 and N-31, respectively, as nonionic surfactants but they did not contain any high-molecular weight hardening agent. Sample No. 58 suffered the generation of a few static marks while sample No. 59 was entirely free from this problem. Nevertheless, both samples experienced extensive unevenness in image density due to the fouling of transport rollers. Sample Nos. 46 to 57 of the present invention contained nonionic surfactants and high-molecular weight hardening agents within the scope of the present invention. None of these samples were affected by static marks and they were free from the problem of unevenness in image density due to the fouling of transport rollers. Furthermore, the addition of surfactants to these samples caused little or no drop in their photographic sensitivity.

What is claimed is:

1. A silver halide photographic element comprising: a support; a silver halide emulsion layer on said support;

and at least one hydrophilic colloidal layer hardened with a hardening agent on said silver halide emulsion layer, wherein said hardening agent is present in an amount ranging from 0.0005 to 0.05 equivalents per 100 g of hydrophilic colloid, has a number average molecular weight of at least 3,000 and contains at least two hardening groups in the same molecule, said hardening groups selected from the group consisting of aldehyde, epoxy, active halide, active vinyl and active ester groups, said colloidal layer comprising at least one of (i) an organic fluoro-compound present in an amount ranging from 0.1 to 2,000 mg/m$^2$ of the photographic element and (ii) a nonionic surfactant having at least one polyoxyethylene unit, said nonionic surfactant being present in an amount ranging from 1.0 to 1,000 mg/m$^2$ of the photographic element, and the ratio of organic fluoro-compound to nonionic surfactant, when used in combination, ranging from 0.001 to 1.0, and wherein said hardening agent, said organic fluoro-compound and said nonionic surfactant are each different from each other.

2. The silver halide photographic element according to claim 1 wherein said hydrophilic colloidal layer is non-light-sensitive layer farthest from said support.

3. The silver halide photographic element according to claim 2 wherein said colloidal layer comprises an organic fluoro-compound and said non-light-sensitive layer contains said organic fluoro-compound.

4. The silver halide photographic element according to claim 3 wherein said organic fluoro-compound is a fluorine-containing surfactant of the formula:

$$Rf—(—A—)_m—X$$

wherein Rf is a substituted or unsubstituted alkyl, alkenyl or aryl group having at least three fluorine atoms; A is a divalent linking group; X is a hydrophilic group; and m is an integer of 0 or 1.

5. The silver halide photographic element according to claim 3 wherein said hardening agent has a hardening group selected from the group consisting of a vinyl sulfone group and a group from which a vinyl sulfone group is derived.

6. The silver halide photographic element according to claim 1 wherein said hydrophilic colloidal layer comprises an organic fluoro-compound which is fluorine-containing surfactant of the formula:

$$Rf—(—A—)_m—X$$

wherein Rf is a substituted or unsubstituted alkyl, alkenyl or aryl group having at least three fluorine atoms; A is a divalent linking group; X is a hydrophilic group; and m is an integer of 0 or 1.

7. The silver halide photographic element according to claim 1 wherein said hardening agent has a hardening group selected from the group consisting of a vinyl sulfone group and a group from which a vinyl sulfone is derived.

8. The silver halide photographic element according to claim 1 wherein said element is a color photographic element.

9. The silver halide photographic element according to claim 8 wherein said hydrophilic colloidal layer is a non-light-sensitive layer farthest from said support.

10. The silver halide photographic element according to claim 8 wherein said hydrophilic colloidal layer is a non-light-sensitive layer farthest from said support, and said hardening agent has a hardening group selected from the group consisting of a vinyl sulfone group and a group from which a vinyl sulfone group is derived.

11. The silver halide photographic element according to claim 8 wherein said hydrophilic colloidal layer contains an organic fluoro-compound, and said hardening agent has a hardening group selected from the group consisting of a vinyl sulfone group and a group from which a vinyl sulfone group is derived.

12. The silver halide photographic element according to claim 1 wherein said organic fluoro-compound is a fluorine-containing surfactant of the formula:

$$Rf—(—A—)_m—X$$

wherein Rf is a substituted or unsubstituted alkyl, alkenyl or aryl group having at least three fluorine atoms; A is a divalent linking group; X is a hydrophilic group; and m is an integer of 0 or 1, said hardening agent having a hardening group selected from the group consisting of a vinyl sulfone group and a group from which a vinyl sulfone is derived.

13. The silver halide photographic element according to claim 1 wherein the amount of said hardening agent ranges from 0.0005 to 0.02 equivalents per 100 g of hydrophilic colloid, the amount of said organic fluoro-compound ranges from 0.5 to 800 mg/m$^2$ of the photographic element, the amount of said nonionic surfactant ranges from 0.5 to 200 mg/m$^2$ of the photographic element and said ratio of organic fluoro-compound to nonionic surfactant ranges from 0.01 to 0.8.

* * * * *

UNITED STATES PATENT AND TRADEMARK OFFICE

CERTIFICATE OF CORRECTION

PATENT NO. : 4,956,270

DATED : September 11, 1990

INVENTOR(S) : Noriki Tachibana et al.

It is certified that error appears in the above-identified patent and that said Letters Patent is hereby corrected as shown below:

Title Page:

In the Abstract, Line 5, change "polyoxuehylene" to --polyoxyethylene--;

Column 2, Line 62, change "3636/1981" to --43646/1981--;

Column 2, Line 68, change "2242/1983" to --82242/1983--;

Claim 2, Column 59, Line 26, after "is" insert --a--;

Claim 6, Column 59, Line 50, after "is" insert --a--.

Signed and Sealed this

Twentieth Day of October, 1992

*Attest:*

DOUGLAS B. COMER

*Attesting Officer*

*Acting Commissioner of Patents and Trademarks*